US007316634B2

(12) United States Patent
Webber

(10) Patent No.: US 7,316,634 B2
(45) Date of Patent: Jan. 8, 2008

(54) EXERCISE ARM APPARATUS WITH PIVOTAL LINKAGE SYSTEM

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 835 days.

(21) Appl. No.: 10/254,386

(22) Filed: Sep. 25, 2002

(65) Prior Publication Data

US 2003/0022767 A1 Jan. 30, 2003

Related U.S. Application Data

(63) Continuation-in-part of application No. 09/772,812, filed on Jan. 30, 2001, now Pat. No. 6,491,609.

(51) Int. Cl.
*A63B 21/00* (2006.01)

(52) U.S. Cl. ..... 482/93; 482/137; 482/100; 482/97

(58) Field of Classification Search ..... 483/93, 483/137, 97, 100–103, 135–139, 142, 72; 482/137, 129, 133, 142, 95, 96, 97, 130, 482/99, 100

See application file for complete search history.

(56) References Cited

U.S. PATENT DOCUMENTS

| | | | | |
|---|---|---|---|---|
| 3,640,528 | A | | 2/1972 | Proctor |
| 4,354,675 | A | | 10/1982 | Barclay et al. |
| 4,390,179 | A | | 6/1983 | Szkalak |
| D321,024 | S | | 10/1991 | Brentham |
| 5,104,121 | A | | 4/1992 | Webb |
| 5,108,095 | A | * | 4/1992 | Nichols ..... 482/137 |
| 5,116,297 | A | | 5/1992 | Stonecipher |
| 5,217,422 | A | | 6/1993 | Domzalski |
| 5,263,914 | A | | 11/1993 | Simonson et al. |
| 5,263,915 | A | | 11/1993 | Habing |
| 5,352,171 | A | * | 10/1994 | Lin ..... 482/96 |
| 5,366,432 | A | | 11/1994 | Habing |
| 5,417,633 | A | | 5/1995 | Habing |
| 5,437,589 | A | | 8/1995 | Habing |
| D370,039 | S | | 5/1996 | May et al. |
| D370,040 | S | | 5/1996 | Habing et al. |

(Continued)

OTHER PUBLICATIONS

B35G Rigid Lat Pulldown, Magnum Fitness Brochure, 1993.

(Continued)

*Primary Examiner*—Jerome Donnelly
(74) *Attorney, Agent, or Firm*—Procopio, Cory, Hargreaves & Savitch LLP

(57) ABSTRACT

An exercise arm apparatus has a stationary frame member, a first pivoting arm pivoted to the frame member at a location intermediate its ends for rotation about a first pivot axis, a second pivoting arm pivotally connected to the frame member for rotation about a second pivot axis spaced from the first pivot axis, and a connecting link pivotally connected to the first arm and second arm to form a four-bar linkage. The first arm is an exercise arm with handles at one end for gripping by a user, and the connecting link is of sufficient weight to form a counter-weight to counter-balance the first exercise arm into a rest position corresponding to a start position for an exercise movement. In one example the connecting link is a solid, elongate bar of heavy metal or equivalent material.

27 Claims, 12 Drawing Sheets

U.S. PATENT DOCUMENTS

| | | | | |
|---|---|---|---|---|
| 5,514,060 | A | 5/1996 | Hu | |
| 5,580,340 | A | 12/1996 | Yu | |
| 5,582,564 | A | 12/1996 | Nichols et al. | |
| 5,597,375 | A | 1/1997 | Simonson | |
| 5,669,865 | A | 9/1997 | Gordon | |
| 5,749,813 | A | 5/1998 | Domzalski | |
| 5,779,601 | A | 7/1998 | Ish, III | |
| 5,810,701 | A | 9/1998 | Ellis | |
| 6,004,247 | A | 12/1999 | Webber | |
| 6,074,328 | A | 6/2000 | Johnson | |
| D439,941 | S | 4/2001 | Batca et al. | |
| D440,609 | S | 4/2001 | Batca et al. | |
| D440,611 | S | 4/2001 | Batca et al. | |
| 6,491,609 | B2 * | 12/2002 | Webber | 482/99 |
| 6,500,106 | B1 * | 12/2002 | Fulks | 482/137 |
| 6,746,378 | B2 * | 6/2004 | Morris et al. | 482/100 |
| 2002/0119871 | A1 * | 8/2002 | Fulks | 482/93 |

OTHER PUBLICATIONS

Lat Pulldown, Boss Fitness Brochure, 1993.

Flex Fitness Brochure, date unknown.

Rotary Lat Pulldown A.R.T. 4500, Paramount Fitness Brochure, 1997.

Paramount Fitness Brochure, 1999.

Nautilus Lat Pulldown Machine, Nautilus Brochure, 2000.

Nautilus Advertisement, Nautical Fitness Trade Journal, Summer 2000.

* cited by examiner

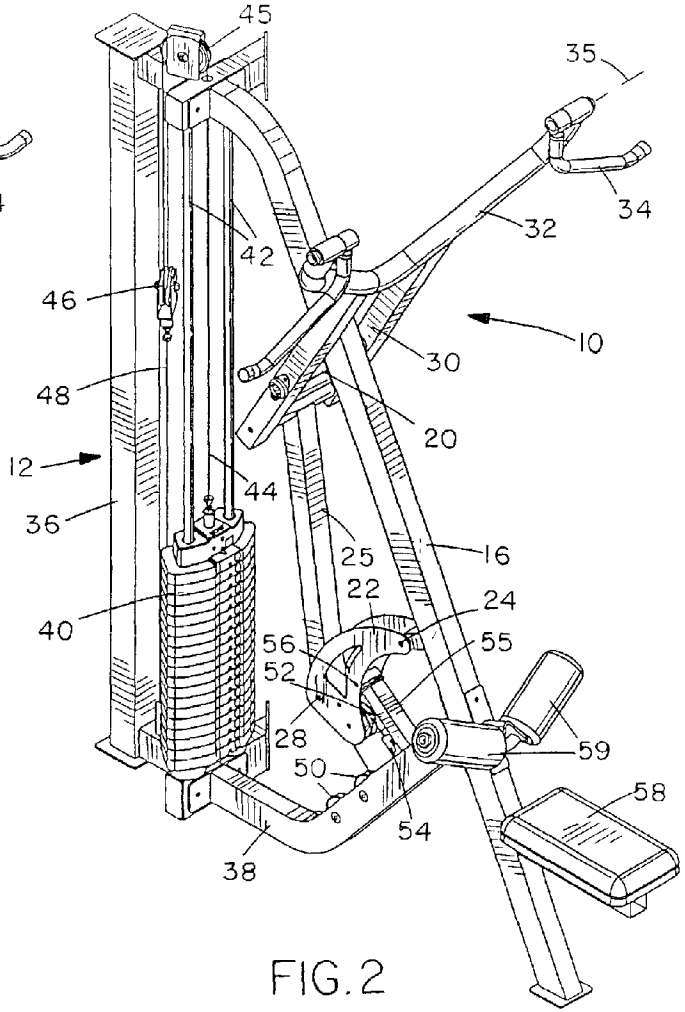
FIG. 2
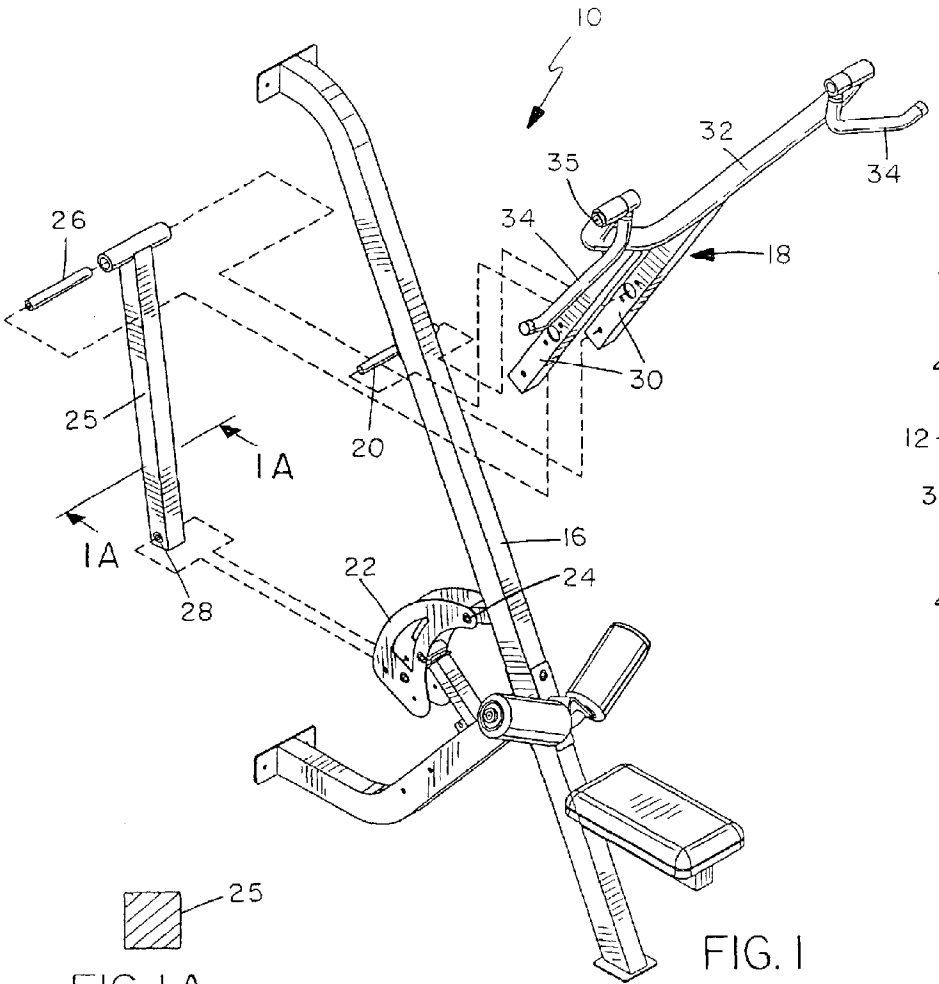
FIG. 1
FIG. 1A

EXERCISE ARM APPARATUS WITH PIVOTAL LINKAGE SYSTEM

CROSS REFERENCE TO RELATED APPLICATIONS

This application is a Continuation In Part of application Ser. No. 09/772,812 filed Jan. 30, 2001 now U.S. Pat. No. 6,491,609.

BACKGROUND OF THE INVENTION

The present invention relates generally to weight lifting exercise machines, and is particularly concerned with an exercise arm apparatus for such a machine having pivotal linkage system for linking the arm to an exercise resistance such as a weight stack, springs, or other load.

The pulldown exercise is one of the most basic and oldest exercises in fitness. It is designed to exercise the major muscles in the upper back. The earliest machines designed to perform this exercise consisted of little more than a pulley mounted on the ceiling with a rope reeved around it. The rope was attached to a load at one end and a horizontal bar at the other end. In order to perform exercises, the exerciser would sit or kneel on the ground beneath the bar, reach up and grab the bar, and pull it downward, stopping close to their head at approximately shoulder level.

In an effort to improve comfort, freestanding machines with seats attached for the exerciser were soon designed. One such machine is described in U.S. Pat. No. 3,640,528 of Proctor. The major disadvantage in these machines is that it is difficult for the user to maintain strict form when performing the exercise. The bar is attached directly to a flexible line, such as a rope, cable, belt, chain or the like, and the user can therefore pull the bar off to one side or the other, or lean backward while pulling the bar downward, which could stress or strain the muscle in the lower back. Also, this machine has a reduced range of exercise motion. The single piece horizontal bar limits the amount of exercise travel because the user cannot pull it past their upper chest or back (depending on whether it is pulled down in front or behind the head). A further disadvantage is convenience and safety. The user must tilt their head either forwards or backwards at just the right moment in order to avoid hitting themselves with the bar.

The disadvantages of the original pulldown machines brought about the development of the rigid arm pulldown machine. This consists of a frame, a seat for the user mounted on the frame, a generally U shaped exercise arm equipped with handles set apart at a distance slightly greater than shoulder width, and a resistive force or load. The arm, which is resisted by the load, is pivotally connected to the frame and angles upward in the rest position, with the handles located high above the seat. In order to perform exercises, the seated user reaches up and grabs the handles, then pulls the arm downward slightly past shoulder level. The rigid arm pulldown works the same muscles as a traditional pulldown machine. However, because it does not have a free-swinging bar extending horizontally from hand-to-hand, it provides a safer, more restricted exercise movement with a greater range of travel.

Some rigid arm pulldown machines include a four-bar linkage system as a way to control the path of travel of the exercise arm, as in U.S. Pat. No. 5,104,121 of Webb, or the resistance supplied to the exercise arm, as in U.S. Pat. No. 5,366,432 of Habing. The four-bar linkage system has four major components: a stationary member or frame, two pivoting members each pivotally connected to the stationary frame member at spaced positions, and a connecting link that is pivotally connected to the two pivoting members. One of the pivoting members acts as the exercise arm to be engaged by the user.

One disadvantage to the rigid arm design is the weight of the exercise arm. Because most of the arm is forward of the pivoting connection to the stationary frame member, it must be counter-balanced so that it will stay in the up or rest position when resistance is being removed or adjusted. This can be accomplished in several ways, such as attaching a weight to the rear end of the arm, i.e. the opposite side of the pivot to the handle, attaching springs to the rearward end of the arm to return it to the rest position, permanently pinning some weights in a stack of selectorized weights in an amount greater than the balance weight of the arm, or providing an amount of framework for the arm or arm assembly which is greater on the rearward side of the main pivot than on the handle side. Each of these options is subject to some disadvantages.

A weight attached directly to the rearward end of an exercise arm needs to increase in size and weight the closer it is placed to the pivot, or it will not offset the weight of the handle end of the arm. If the counterweight is placed close to the pivot, it will be larger and more expensive. When placed further from the pivot, the arm grows in length and the rear end travels in a large arc. This takes up more space and can pose a safety issue for anyone walking behind the machine. One example of a machine in which weight is attached to the rearward end of an exercise arm to act as a counter-balance is described in U.S. Pat. No. 5,263,914 of Simonson.

U.S. Pat. No. 5,437,589 of Habing is an example of a rigid arm pulldown machine using springs as a counter-balance to return the exercise arm to the rest position. Springs strong enough to offset the weight of the handle and allow for adequate handle travel can end up being fairly long and this will affect the design of the machine. Springs do not maintain an even resistance throughout the length of their stretch, which could affect the resistance and smoothness of motion felt by the user. Over time, springs tend to lose their tension, which would lessen their ability to counter-balance the exercise arm adequately. Additionally, springs tend to fatigue and ultimately break after repeated use, resulting in machine "down time", additional maintenance expense, and possible injury.

In some cases, a portion of the selector weight stack is permanently pinned to provide the required counter-balance weight, for example as shown in the brochure of Magnum Fitness. One disadvantage to such a system is that the amount of resistance available to a user is reduced. This results either in less weight for the weight stack or requires a heavier weight stack, increasing the cost to manufacture the machine.

Some pulldown machines have used an increased size of framework for the arm assembly for counter-balance, as in U.S. Pat. No. 5,217,422 of Domzalski. This uses a complicated linkage system and increases both the size of the machine and the cost to produce it.

SUMMARY OF THE INVENTION

It is an object of the present invention to provide a new and improved exercise arm linkage system for an exercise apparatus.

According to one aspect of the present invention, an exercise apparatus is provided which comprises a stationary frame having a forward end and a rear end, an exercise arm assembly pivotally mounted on the frame, and an exercise resistance linked to the exercise arm assembly, the exercise arm assembly comprising a first, exercise arm pivotally connected to the frame for rotation about a first pivot axis, the first exercise arm having a forward portion projecting forwardly from the first pivot axis and a rear portion projecting rearwardly from the first pivot axis, a second arm pivotally connected to the frame for rotation about a second pivot axis spaced from the first pivot axis, and a connecting link member pivotally connected to the rear portion of the first arm and to the second arm, the connecting link member comprising a counter-weight of predetermined weight to counter-balance the forward portion of the first exercise arm into a rest position.

In an exemplary embodiment, the connecting link member is a solid metal bar of square, round or rectangular cross-section, such as a 2" by 2" solid steel bar or other bar of equivalent weight, rather than the typical, lighter flat bar or hollow tubing found in the prior art which will have little counter-balancing effect. This provides the necessary weight to offset the first or exercise arm and provides a safe, compact and cost efficient design, avoiding the need for expensive, add-on counterweights, springs, complicated linkage systems, or the like.

Both pivoting arms may be pivotally mounted on a single frame member of the frame, with the first, exercise arm spaced above the second arm and having handles at its forward end for engagement by a user, and the second arm or the connecting link member linked to the load or exercise resistance. The arrangement may be such that the connecting link member travels in substantially vertical, straight line as the arms are pivoted about their respective pivot axes. The second arm may be shorter in length than the first exercise arm such what the rearward extension of the assembly is reduced.

The exercise resistance in one example may be provided by weight plates removably mountable on the connecting link. In another example, a load-bearing cable linked to a weight stack or the like supplies the exercise resistance. The load-bearing cable may be linked to the second arm or to the end of the connecting link, such that it travels in a substantially straight line throughout the exercise motion. The load-bearing cable may be terminated at the exercise arm assembly, or may travel on to an additional exercise station. In the case of either removable weight plates or a load-bearing cable, the exercise resistance will travel in a substantially straight line, providing uniform resistance throughout the exercise motion.

Because the connecting link of a four-bar linkage system acts as the counter-weight in this invention, and travels in a substantially straight line rather than arcing up and out, the apparatus is safer and there is less risk of a counterbalance accidentally striking and injuring someone near the machine. The moving parts on a four-bar linkage system are much more visible, and hence more readily avoided, than a counter-weight attached to a free end of an exercise arm. The counter-balancing connecting link of this invention is attached to the rear ends of the two pivoting arms so that nothing protrudes past it.

In some embodiments of the invention, the forward portion of the first exercise arm comprises a generally U-shaped member having handles at its free ends for engagement by a user. In other embodiments, the forward portion is also generally U-shaped with two spaced side portions, and each side portion is connected to one end of a respective swing arm by means of a three dimensional or universal pivot joint. Handles are connected at the opposite ends of the respective swing arms. The handles have rotatable grips to allow the user's wrists to adjust comfortably to the various positions of the hands and arm during exercise movements. The universal pivot joint may have three perpendicular pivots. In an alternative arrangement, each handle is connected to the end of the respective side portion by a flexible strap member. The opposite end of each strap member is suitably linked to the respective arm side portion to provide a universal joint, for example by means of a suitable clip or ring engaging an opening or eyelet at the end of the arm side portion.

In each of the above embodiments, the exercise arm assembly may comprise a single second arm and connecting link, with the first arm being generally U-shaped along a forward portion or all of its length to provide connection points for two separate handles or a three dimensional pivot linkage to two separate handles. Alternatively, in any of the above cases, a separate exercise arm assembly may be provided on each side of the user for engagement by the user's opposite arms and hands. In this case, a pair of first exercise arms are pivotally connected to the frame for rotation about a first pivot axis, with forward portions of each first exercise arm projecting forwardly from the first pivot axis and rearward portions of each first exercise arm projecting rearwardly from the first pivot axis. A pair of second arms are pivotally connected to the frame for rotation about a common second pivot axis spaced from the first axis, and a pair of connecting links are pivotally connected to the rear portion of a respective first arm and to a corresponding second arm. A pair of handle assemblies are connected to the forward portions of the respective first exercise arms, either directly or via a three dimensional pivot linkage or elongate strap handle providing a universal pivot attachment.

The two exercise arm assemblies are separately connected to the load and can be used independently of one another, or may be pulled together if desired. This arrangement distributes the load or resistance uniformly to each arm, preventing the user's dominant arm from doing more of the work during the exercise movement.

The apparatus of this invention will be of relatively low cost to manufacture, due to its simplicity and reduced material requirements. In prior art arrangements where a large block of steel was required as a counterbalance, material expense is increased, and further machining is required to attach the block to the end of a pivot member or exercise arm. In contrast, with the present invention, the same amount of work is required to mount the connecting link as would be needed if the connecting link were made of hollow tubing, as in the past, and no additional parts need to be attached in order to provide the required counter-weight. Solid metal bar does not cost as much as a large block of steel or extra weight plates. This arrangement also does not require a portion of the weight stack to be permanently pinned, thereby providing more available exercise weight.

A further benefit of this arrangement is the consistent resistance delivered to the user. Because the connecting link travels in a substantially straight line, there is no resistance change or "camming over" effect to the counter-balance, as would occur with a leverage type counter-balance which travels in an arcuate path. As the position of such a counter-balance changes along the path, there will be a slight variation in the counter-balancing effect which will be felt by the user. With a spring counter-balance as used in some prior art devices, there will also be a resistance change as the spring stretches. In the present invention, the load bearing cable will travel in a substantially straight line so that there is no "drop off" in resistance felt by the user.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 1 is an exploded perspective view of an exercise arm apparatus according to a first embodiment of the invention;

FIG. 1A is a cross sectional view of the connecting link of the apparatus of FIG. 1 on lines 1A-1A of FIG. 1, illustrating its solid metal structure;

FIG. 2 is a perspective view of an exercise machine incorporating the exercise arm apparatus of FIG. 1;

DETAILED DESCRIPTION OF THE DRAWINGS

Figure 3:
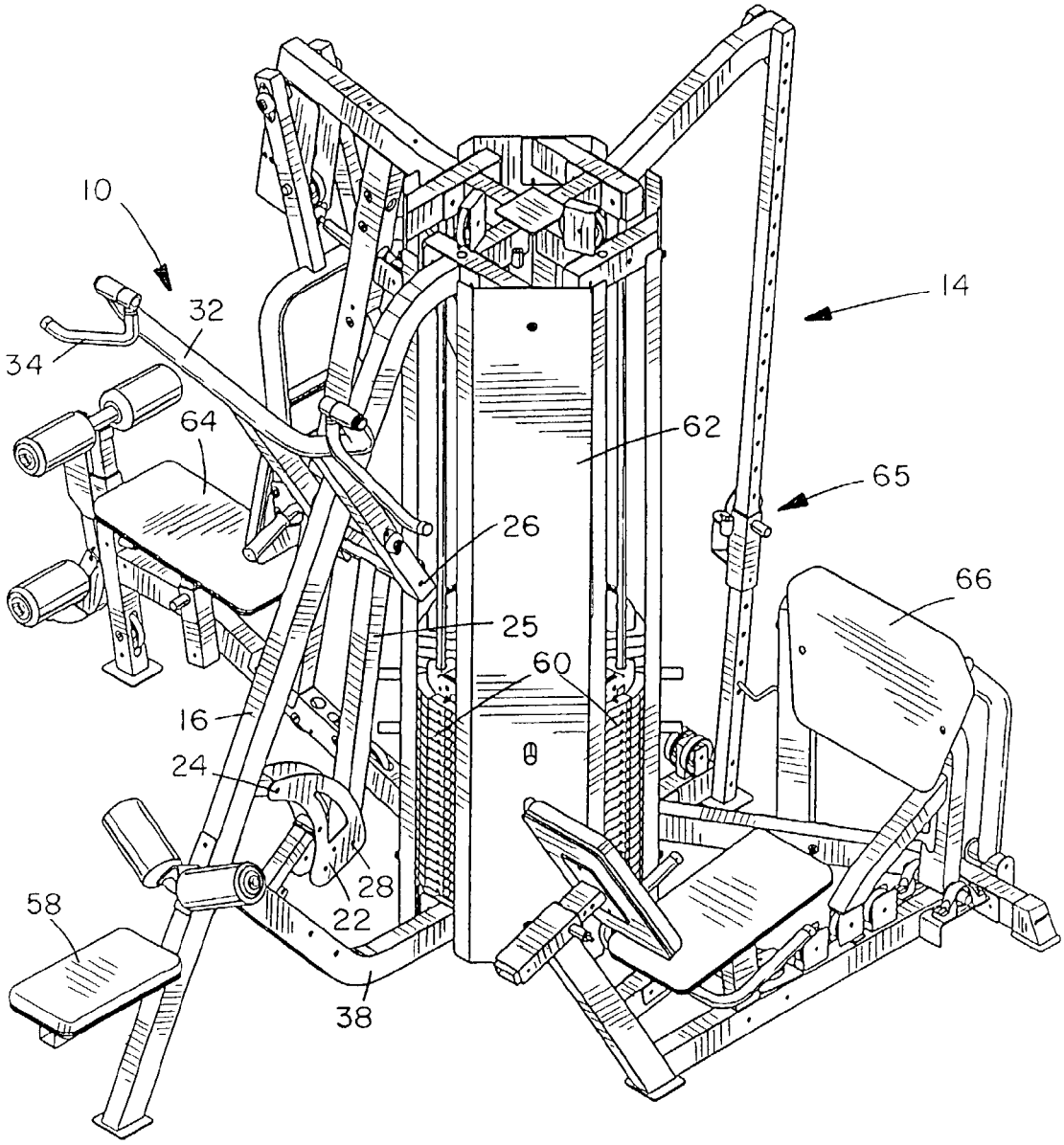
FIG. 3 is a perspective view of another, multi-station exercise machine incorporating the exercise arm apparatus of FIG. 1.
Figure 5:
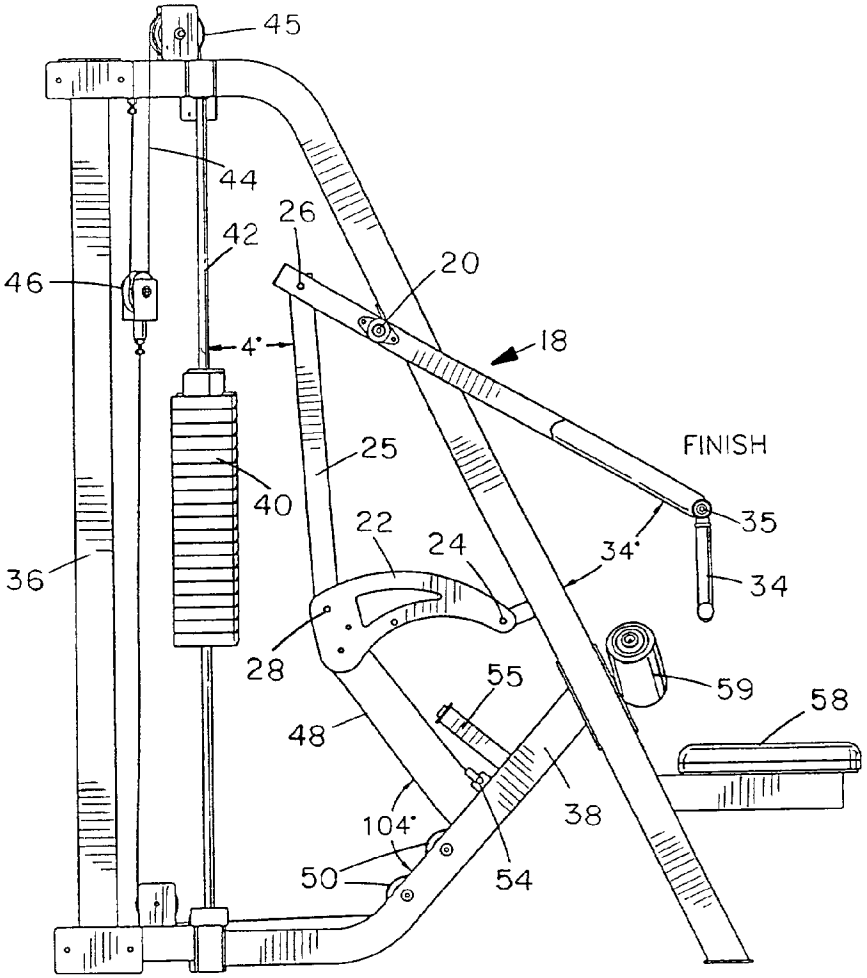
FIG. 5 is a side elevational view similar to FIG. 4 illustrating the end position of the apparatus at the end of an exercise movement.
Figure 4:
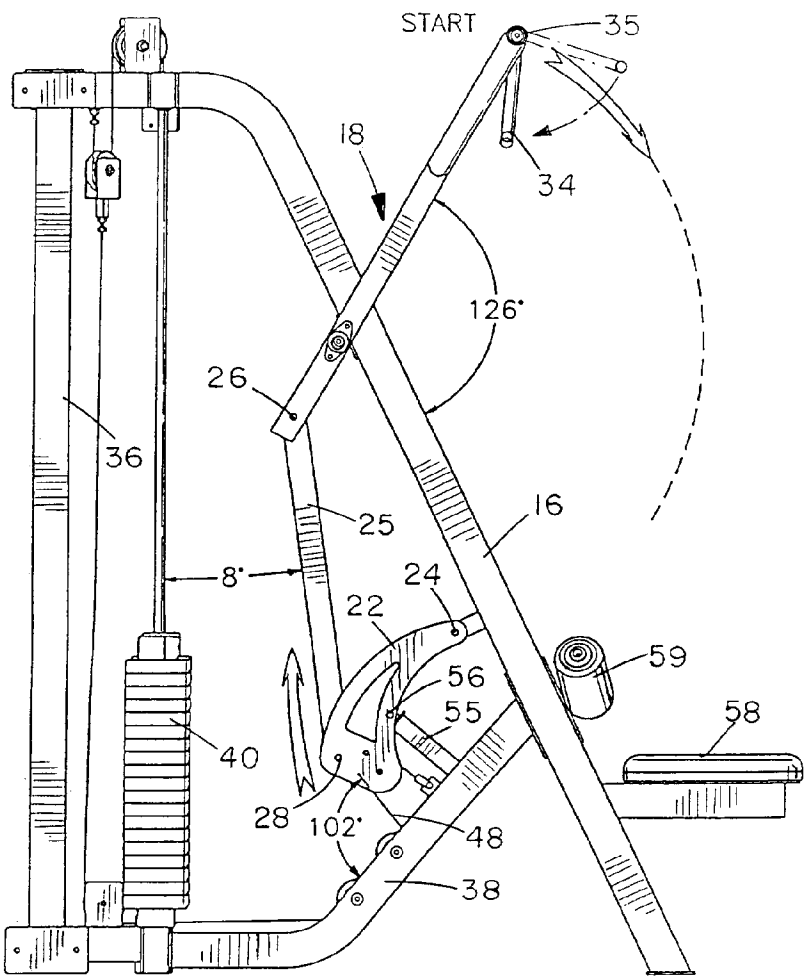
FIG. 4 is a side elevational view of the apparatus of FIG. 2 illustrating the start or rest position of the exercise arm apparatus and the direction of travel of the handle end of the exercise arm and the connecting link from the start position.

FIGS. 1 and 1A of the drawings illustrate an exercise arm apparatus 10 according to a first embodiment of the present invention, while FIGS. 2, 4 and 5 illustrate the apparatus 10 mounted on a first exercise machine 12, and FIG. 3 illustrates the apparatus 10 mounted on a different, multi-station exercise machine 14. As best illustrated in FIG. 1, the apparatus 10 basically comprises a generally upwardly extending, rearwardly inclined, stationary frame member 16, a first pivoting arm 18 pivoted to the frame member 16 via pivot pin 20, a second pivoting arm 22 pivoted to the frame member 16 by pivot pin 24, and a connecting link 25 having an upper end pivoted to the rear end of arm 18 via pivot pin 26 and a lower end pivoted to the rear end of the arm 22 via pivot 28. This provides a linkage system of the type generally known as a four-bar linkage.

The first or upper pivoting arm 18 comprises an exercise arm and is formed by a pair of parallel bars 30 pivoted to the pin 20 on opposite sides of frame member at an intermediate position in their length such that the rear ends of bars 30 project rearwardly from member 16, and a generally U-shaped yoke 32 secured to the forward ends of the bars 30 at its central region such that opposite side portions of the yoke project forwardly from the bars. Handles 34 are pivotally mounted at the free ends of the U-shaped yoke 32 for rotation about a generally horizontal pivot axis 35.

The connecting link 25 is formed as a counter-weight which acts to counter-balance the forwardly projecting portion of the arm 18, such that the arm will remain in the upper or rest position of FIGS. 2 and 4 when resistance is being removed or adjusted. Thus, the link 25 is of predetermined weight necessary to counter-balance the forwardly projecting weight of arm 18 forward of pivot 20. In the illustrated embodiment, the link 25 is a solid elongate metal bar, and may be a 2" by 2" solid steel bar, as illustrated in FIG. 1A, for example, which has a weight of over 13.5 lbs per linear foot, as compared to 3 lbs per linear foot for the same size of hollow tubing. It may alternatively be a solid round or rectangular bar, for example, and may be made of other, similarly heavy materials in alternative embodiments. The remaining parts of the exercise arm assembly will be of hollow tubing.

As illustrated in FIGS. 2,4 and 5, the exercise arm apparatus 10 is mounted on an exercise machine 12 with the stationary frame member 16 forming part of the frame of the machine. The machine frame includes a rear upright strut 36 and a forwardly projecting base strut 38 projecting from the lower end of strut 36 and inclined upwardly to meet frame member 16. The upper end of frame member 16 is secured to the upper end of upright strut 36. A weight stack 40 is slidably mounted on vertical guide rods 42 extending between the upper and lower end of the machine frame in front of rear upright strut 36, and is linked via a cable and pulley system to the second pivoting arm 22. A first load-bearing cable 44 extends from the top of the weight stack around pulley 45 at the top of the frame and downwardly around floating pulley 46, and is then anchored to the frame, or may extend to another exercise station. A second-load bearing cable 48 has a first end connected to the housing of pulley 46, and extends around guide pulleys 50 on the base strut 38, around a pulley 52 on the arm 22, and is then secured to a cable tie-off 54 on the strut 38. It will be understood that different load bearing systems may replace the load bearing cables, such as belts, ropes or chains.

The second pivoting arm 22 is formed by two spaced parallel plates pivoted at their forward ends to frame member 16 at pivot 24 and pivoted at their rear ends to the connecting link 25 via pivot 28. The pulley 52 is rotatably mounted between the two plates forming arm 22, as illustrated in FIG. 2. A spacer bar 55 projecting from the upwardly inclined portion of base strut 38 towards the arm 22 acts as a stop by engaging a pin 56 extending between the plates, as best indicated in FIG. 2.

A suitable seat 58 and thigh brace pad 59 for a user are mounted on a user supporting portion of the upwardly inclined frame member or strut 16 beneath the forward end of the exercise arm 18, such that a user seated on seat 58 can lift their arms over their head to grip handles 34. The user may be seated facing the frame member 16 for some exercises, or with their back to frame member 16 for other exercises.

FIGS. 4 and 5 of the application illustrate pivotal movement of the exercise arm apparatus between an upper, rest or start position as illustrated in FIG. 4, and a lower, end position as illustrated in FIG. 5. FIG. 4 also illustrates pivotal up and down movement of the handles 34 between an upper, dotted line position and a lower, solid line position. As indicated in FIG. 4, in the rest or start position of the apparatus, the exercise arm 18 is inclined upwardly from its rear end to its forward end, such that the handles 34 will be positioned above the head of a user seated in seat 58. The counter-weight of the relatively heavy, solid bar connecting link 25 will tend to urge and hold the exercise arm in the illustrated position, even when the resistance or weight stack is being adjusted. In the rest position, the connecting link 25 is substantially vertical, oriented at an angle of 8° to the vertical guide rods 42 and rear strut 36, and the exercise arm 18 is at an angle of around 126° the the frame member 16. The load bearing cable 48 extends at an angle of around 102° to the inclined portion of base strut 38, as indicated.

In order to perform an exercise, the user will grip the two handles 34 and urge them downwardly in an arcuate path as generally indicated by the arrow and dotted line in FIG. 4. This will pull the connecting link 25 in a generally upward vertical direction, as indicated by the arrow adjacent pivot 28. At the same time, the pivotally mounted handles will self-align during the arcuate movement so that the user does not have to re-adjust their grip as the arm is pulled down, from the start position illustrated in dotted outline to the end position illustrated in solid outline.

FIG. 5 illustrates the position of the exercise arm 18 at the end of an exercise movement, when the user has pulled the handles down along opposite sides of their body. The arm 18 is now inclined downwardly from the rear end to the forward end, at an angle of around 34° to the frame member 16. However, the connecting link 25 is still oriented substantially vertically, at an angle of around 4° to the vertical guide rods 42. The load-bearing cable 48 also remains at substantially the same angular orientation of around 104° to base strut 38.

With this arrangement, one of the two pivoting arms of the four-bar linkage acts as the exercise arm, while the other pivoting arm is linked to the load. However, in alternative arrangements, the connecting link may be linked to the load. The arrangement is such that the counter-balance or counter-weight 25 travels in a substantially vertical direction and in a substantially straight line between the rest and end positions, so that less space is required to accommodate the counter-balance to the rear of the frame member 16. This also helps to ensure that consistent, substantially unvarying resistance is felt by the user over the exercise motion, eliminating any "camming over" effect which would occur with a leverage type counter-balance traveling through an arcuate path. The angle of the load bearing cable 48 attached to the second arm 22 also changes by only a few degrees during the entire exercise movement, such that it travels in a substantially straight path, which also helps to ensure that there is no decrease in resistance felt by the user.

FIG. 3 illustrates the exercise apparatus 10 of FIG. 1 mounted on a different, multi-station exercise machine 14. The apparatus 10 is identical to that of FIG. 1, and like reference numerals have been used for like parts as appropriate. However, instead of a single weight stack as in FIG. 2, the machine 3 has four weight stacks 60 arranged in a central, vertical housing 62 with different weight stations projecting from each side of the housing and linked to the various weight stacks. In addition to the pull down exercise apparatus 10, the machine 14 also has three other exercise stations 64,65, and 66 for performing various exercises. The exercise apparatus 10 will operate. in exactly the same way as described above in connection with FIGS. 1,2, 4 and 5.

Figure 7:
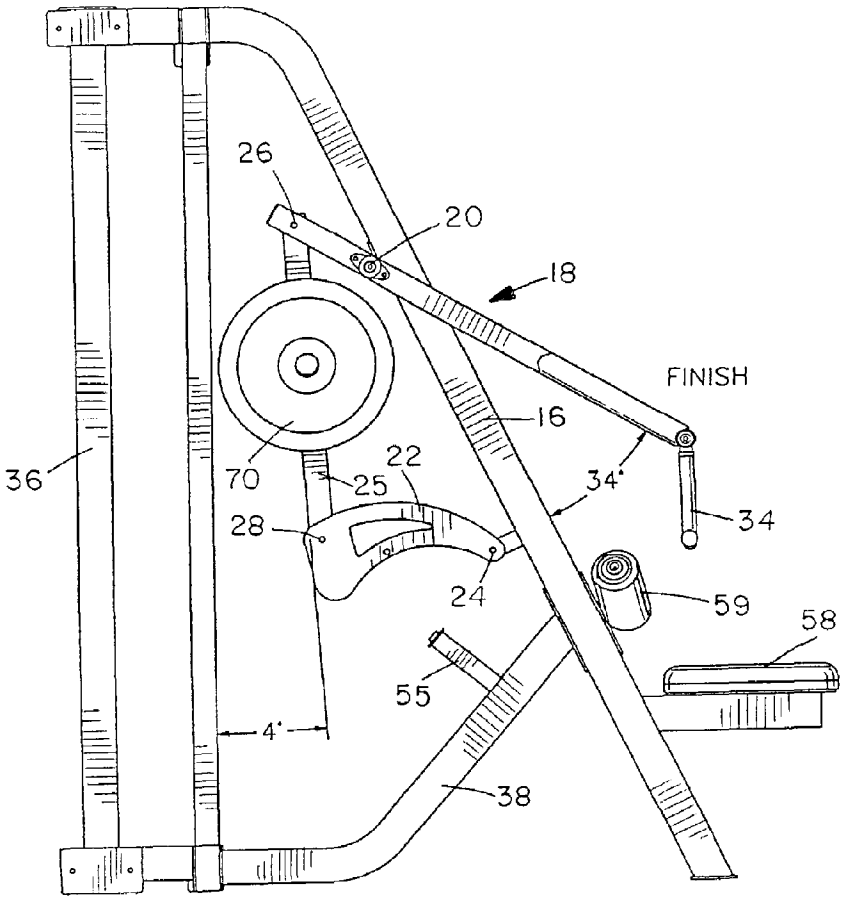
FIG. 7 is a side elevational view of the machine of FIG. 6 illustrating the end position of the exercise arm apparatus.
Figure 6:
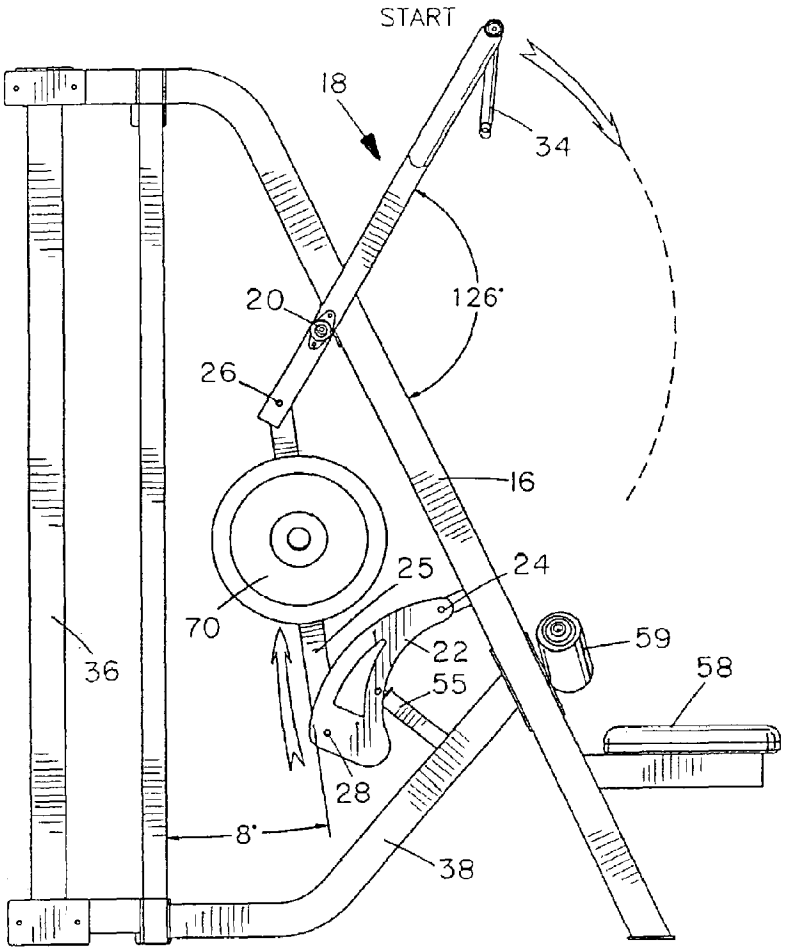
FIG. 6 is a side elevational view similar to FIG. 4 illustrating a modified exercise arm apparatus using removable weights, with the apparatus in the start position.

FIGS. 6 and 7 illustrates a modification to the exercise apparatus 10 of the previous embodiment, in which removable weights 70 are mounted on the counter-weight or connecting link 25 to provide the exercise resistance, instead of using a load bearing cable linked to a weight stack. The apparatus is otherwise identical to that of the previous embodiment, and like reference numerals have been used for like parts as appropriate.

FIG. 6 illustrates the pivotal linkage positioned with the exercise arm 18 in the start or rest position prior to performing an exercise. The arm 18 is inclined upwardly from the rear end to the forward end, with the handles in position above the head of a user seated on seat 58. As in the previous embodiment, the arm is inclined upwardly at an angle of around 126° to the frame member 16 on which it is pivoted. The connecting link 25 is at an angle of around 8° to the rear upright strut of the exercise machine frame. When an exerciser grips the handles 34 and moves the arm 18 downwards in a generally arcuate path as indicated by the arrow and dotted line to the right of the machine, the connecting link 25 and weights 70 will be pulled upwardly in a generally vertical direction. FIG. 7 illustrates the positions of the various members of the four-bar linkage at the end of an exercise movement. As in FIG. 5, the exercise arm 18 finishes up at an angle of around 34° to frame member 16, while the connecting link 25 is still oriented substantially vertically at a slight angle of 4° to the vertical. Thus, since the weights mount directly to the counter-balancing connecting link in this embodiment, they will follow the same, substantially vertical and straight line path as the connecting link, providing a more or less constant, unvarying resistance throughout the exercise movement.

Figure 8:
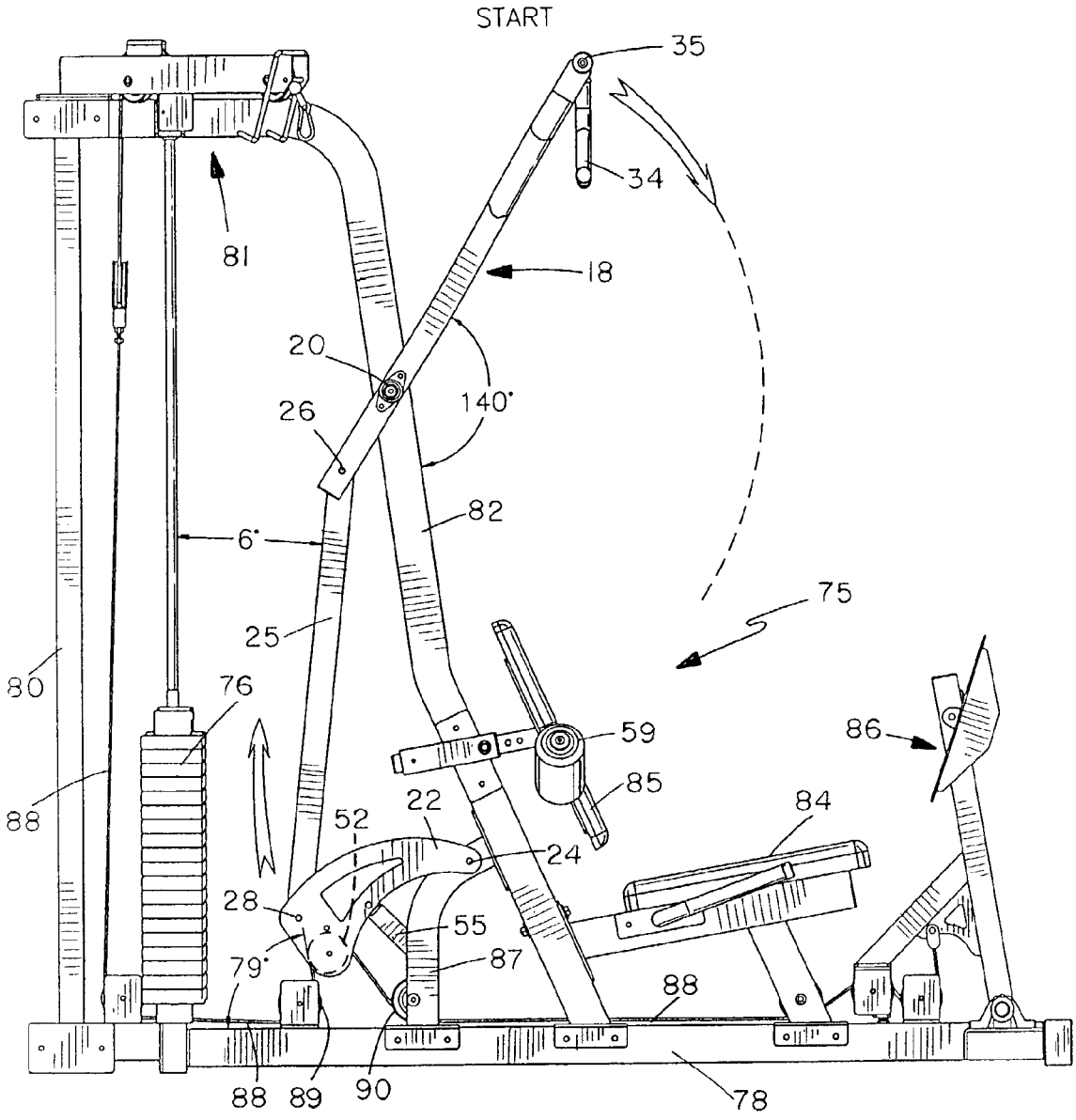
FIG. 8 is a side elevational view illustrating a modified exercise arm apparatus mounted on a different exercise machine having plural exercise stations, showing the start position of the exercise arm apparatus.
Figure 9:
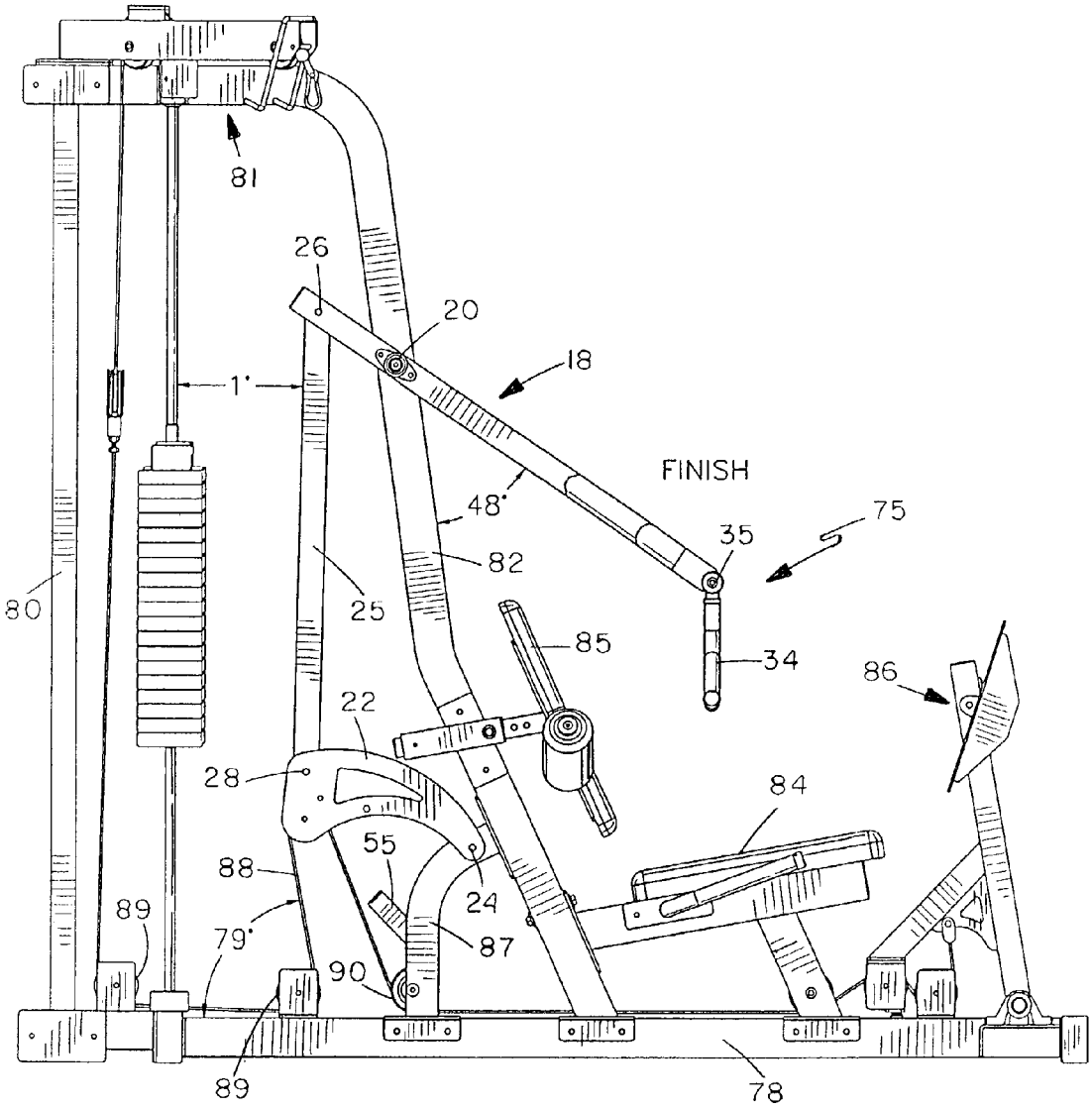
FIG. 9 is a side elevational view similar to FIG. 8 illustrating the end position of the exercise arm apparatus.
Figure 11:
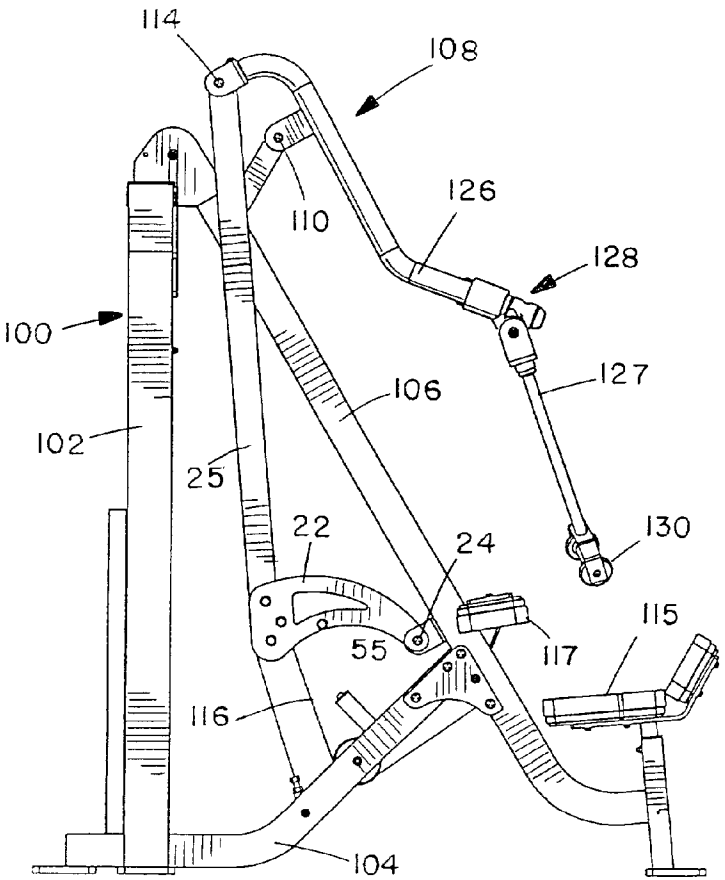
FIG. 11 is a side elevational view of the apparatus of FIG. 10 illustrating a lowered, extended position of the exercise arm assembly.
Figure 10:
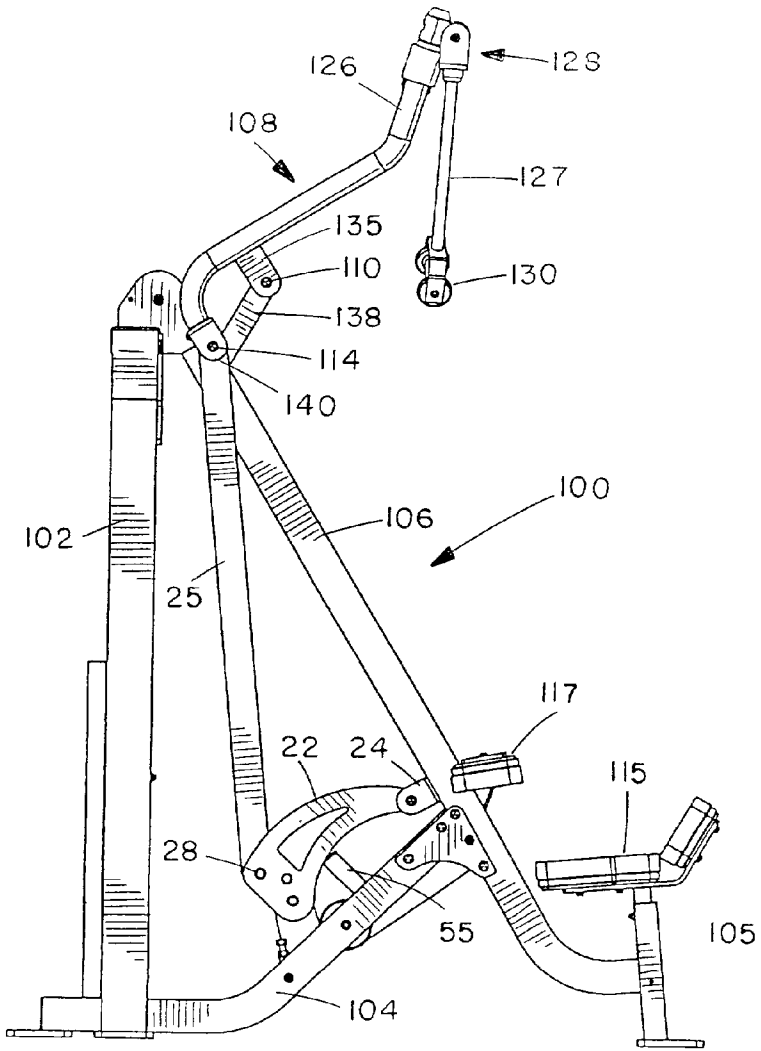
FIG. 10 is a side elevational view of an exercise apparatus according to another embodiment of the invention, in which the exercise arm assembly provides three dimensional movement of the handles relative to the arms, illustrating the start or rest position of the exercise arm assembly.
Figure 13:
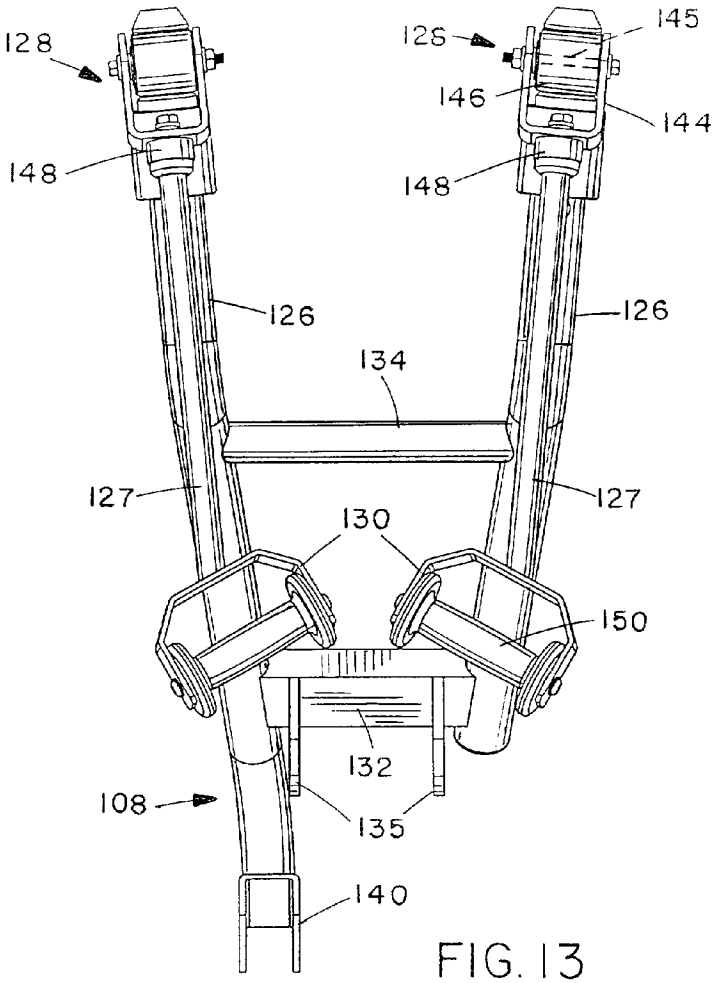
FIG. 13 is a front view of the first exercise arm and swing arms of the exercise arm assembly of FIGS. 10 to 12, illustrating the three dimensional pivot joints.

FIGS. 8 and 9 illustrate another modified exercise machine 75 in which the exercise arm apparatus 10 of the previous embodiments is mounted and linked to an exercise resistance or weight stack 76 in a slightly different manner from the embodiment of FIGS. 1 to 5. The apparatus 10 of FIGS. 8 and 9 is otherwise identical to that of the previous embodiments, and like reference numerals have been used for like parts as appropriate.

In the exercise machine 75 of FIGS. 8 and 9, a stationary frame for the machine has a base, horizontal strut 78 extending from the rear end to the front end of the machine, a rear upright strut 80, a top strut 81 extending forwardly from the upper end of the rear strut, and an upright strut 82 spaced forwardly from strut 80 extending upwardly from the base strut 78 to the top strut 81, with upright strut 82 being inclined slightly rearwardly. A seat pad 84 projects forwardly from the front side of strut 82, and a back pad 85 is mounted on the strut above seat pad 84. Seat pad 84 and back pad 85 are mounted on a user supporting portion of the frame. A leg exercise ann 86 is pivotally mounted at the forward end of the base strut 78 in front of the seat. A short, connecting strut 87 extends upwardly from the base strut 78 at a location spaced behind strut 82 and is joined to the strut 82 at a location spaced below the back pad 85.

The exercise arm 18 of the exercise arm assembly is pivotally mounted on the strut 82 above the seat via pivot rod 20, as in the previous embodiment, while the second pivoting arm 22 is pivoted at its forward end to the strut 82 at pivot 24. The counter-balancing connecting link 25, which is of solid metal rod or bar construction as in the previous embodiments, is pivoted at its upper end to the rear end of exercise arm 18 at pivot 26, and at its lower end to the rear end of arm 22 at pivot 28. A load-bearing cable 88 linked to the weight stack extends around guide pulleys 89 on the base strut 78, around pulley 52 on the arm 22, and then continues on around guide pulley 90 to the leg exercise arm 86 to provide tension to the additional exercise station.

As in the previous embodiments, the counter-balancing link 25 of solid metal such as steel will provide the necessary counter-weight to bias or hold the exercise arm 18 in the upper, rest position of FIG. 8 while weight is removed or adjusted. The connecting link 25 will be substantially vertical in the rest position, as indicated in FIG. 8, at an angle of approximately 6°, while the length of load-bearing cable 88 extending onto the pulley 52 on arm 22 is at an angle of approximately 79° to the horizontal direction or base strut 78. The exercise arm 18 is at an angle of around 140° to strut or frame member 82. Again, in order to perform a pulldown exercise, a user seated on seat 84 will lift their arms to grip handles 34 and pull down in the path indicated by the arrow, simultaneously pulling up the connecting link in a generally vertical direction as indicated by the arrow alongside link 25.

FIG. 9 illustrates the final position of the exercise arm assembly at the end of an exercise movement. The exercise arm 18 is now inclined downwardly at an angle of around 48° to strut 82, while the connecting link 25 is now substantially vertical at a slight angle of around 1° to the vertical direction. The load-bearing cable 88 remains at exactly the same angle of approximately 79° to the horizontal direction or base strut 78. Thus, in this version, the counterbalancing connecting link 25 straightens by 5°, from 6° to 1°, i.e. to an almost vertical orientation, while the load bearing cable maintains a continuous 79° off horizontal throughout the whole pulling exercise, and thus travels in a straight line.

FIGS. 10 to 16 of the drawings illustrate a rigid arm pulldown exercise apparatus 100 according to another embodiment of the invention. The apparatus has an exercise arm assembly incorporating a counter balance or counterweight as part of a four-bar linkage, similar to that of the previous embodiments, but the first arm is modified and connected to the handles via pivoted swing arms. This provides a three dimensional pivot movement along with the advantages of a 4-bar linkage system with a counter-balancing connecting link to return the assembly to a start or rest position. Some components of the apparatus 100 are identical to those in previous embodiments, and like reference numerals have been used for like parts as appropriate.

The exercise apparatus or machine 100 of FIGS. 10 to 16 basically comprises a frame having a rear, vertical member 102, a forwardly projecting base strut 104 with an upwardly inclined forward end portion, a seat supporting strut 105 at the forward end of the frame, and an upwardly inclined, rearwardly projecting strut 106 extending from the strut 105 to the upper end of upright 102. An exercise arm assembly incorporating a four-bar linkage is pivotally mounted on the frame. The exercise arm assembly basically comprises a first exercise arm 108 pivoted to the frame member or strut 106 adjacent its upper end via pivot pin 110, a second pivoting arm 22 pivoted to the strut 106 via pivot pin 24 at a location spaced below pivot pin 110, and a connecting link 25 having an upper end pivoted to the rear end of arm 108 via pivot pin 114, and a lower end pivoted to an end portion of arm 22 via pivot pin 28. This provides a four-bar linkage. A seat 115 is connected to supporting strut 105, and thigh brace pads 117 are located on strut 106 above seat 115.

Figure 12:
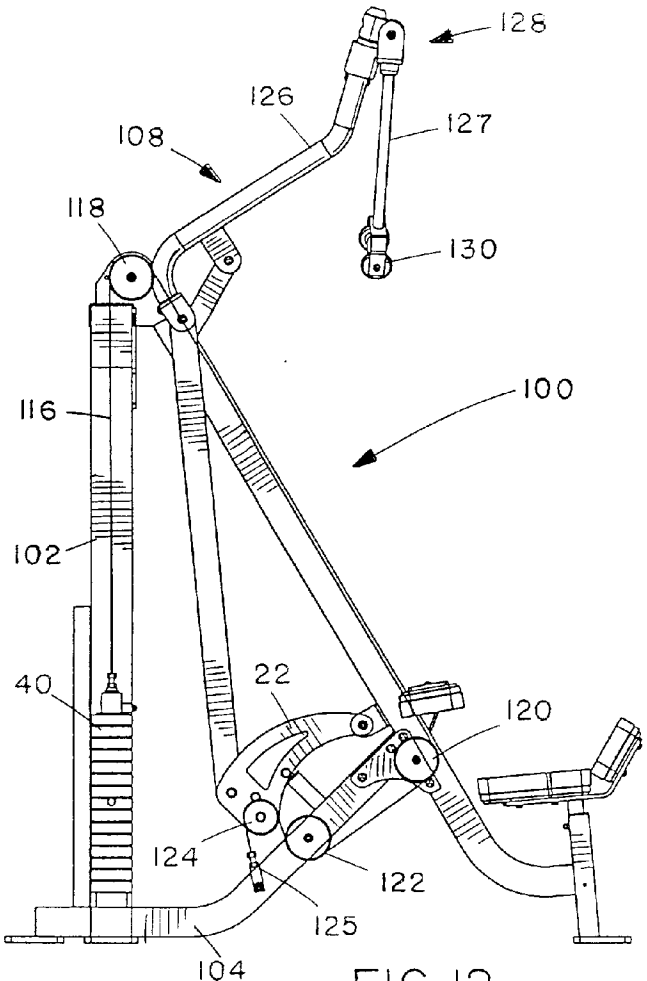
FIG. 12 is a side elevational view of the apparatus of FIG. 10 in the start position, showing the cable routing and hidden components of the apparatus.

The second arm 22 is linked to an exercise resistance such as weight stack 40 via a cable and pulley linkage, as best illustrated in FIG. 12. It will be understood that various other types of exercise resistance and cable and pulley linkage paths may be provided in other embodiments, such as the linkage illustrated in FIG. 4, for example. In the illustrated embodiment, a cable 116 extends from the weight stack, around a pulley 118 at the upper end of upright strut 102, then downwardly along frame member 106, around a second pulley 120 on strut 106 below the pivot pin 24, around a third pulley 122 on base member or strut 104, then around a fourth pulley 124 on the second arm 22, and finally to an anchor 125 on the base member 104. It will be understood that the cable 116 may alternatively extend on to other exercise stations, rather than terminating at anchor 125. Also, the cable 116 may be linked to connecting link 25 rather than second arm 22.

The first exercise arm 108 is different from the exercise arm 18 of the previous embodiments, which had a U-shaped yoke directly connected to handles at its free ends. Instead, the exercise arm 108 has a generally U-shaped forward portion (see FIGS. 13 to 17) with opposite side members 126 having forward ends each connected to one end of a respective swing arm 127 via a three dimensional pivot joint 128, the opposite end of each swing arm being connected to a handle 130. The two side members 126 are connected by a first cross bar 132 and a second cross bar 134 spaced from the first cross bar. A pair of spaced pivot brackets 135 depend downwardly from first cross bar 132 with aligned pivot holes 136 at their lower ends for extending on opposite sides of a pivot post 138 projecting from the upper end of frame member or strut 106. Holes 136 are aligned with a hole in the end of post 138, and pivot pin 110 extends through the aligned holes for pivotal connection of the first exercise arm 108 to the frame. One of the side members 126 extends rearwardly from cross bar 132 and has a U-shaped pivot bracket 140 at its rear end for pivotal connection to the upper end of connecting link 25 via pivot pin 114, as best illustrated in FIGS. 10 to 12 and 16.

The three-dimensional pivot joint 128 linking each swing arm 127 to the respective side member 126 of the first exercise arm 108 will now be described in more detail, with reference to FIGS. 13 to 16, and particularly FIG. 16 which illustrates the different rotation axes with arrows. This joint is similar to the 3-D pivot joint in the exercise arm assembly of my U.S. Pat. No. 6,004,247, the contents of which are incorporated herein by reference. Each pivot joint 128 has three perpendicular pivots allowing rotation of the respective swing arm 127 about the arrows A, B, and C illustrated in FIG. 16. The first pivot comprises a sleeve 142 rotatably mounted on the end of side member 126 for rotation about the axis of the end portion of the side member, as indicated by the arrow A. This pivot controls side to side movement of the respective swing arm.

The second pivot comprises a U-shaped pivot bracket 144, a pivot pin 145 mounted between the ends of bracket 144, and a second sleeve 146 rotatably mounted on pivot pin 145. Sleeve 146 is secured perpendicular to sleeve 142 via connecting flange 147. Sleeve 146 provides rotation about the axis of pin 145, as indicated by the arrow B in FIG. 16, with this pivot axis being perpendicular to the pivot axis of sleeve 142. This pivot controls front to rear movement of the respective swing arm. The third pivot comprises a pivot sleeve 148 projecting from the end wall of U-shaped bracket 144 and rotatably mounted over the end of the swing arm 127, to allow rotation of arm 127 about its own longitudinal axis, as indicated by the arrow C in FIG. 16. The pivot joint therefore provides a three dimensional exercise movement of each swing arm 127 in all directions.

Figure 16:
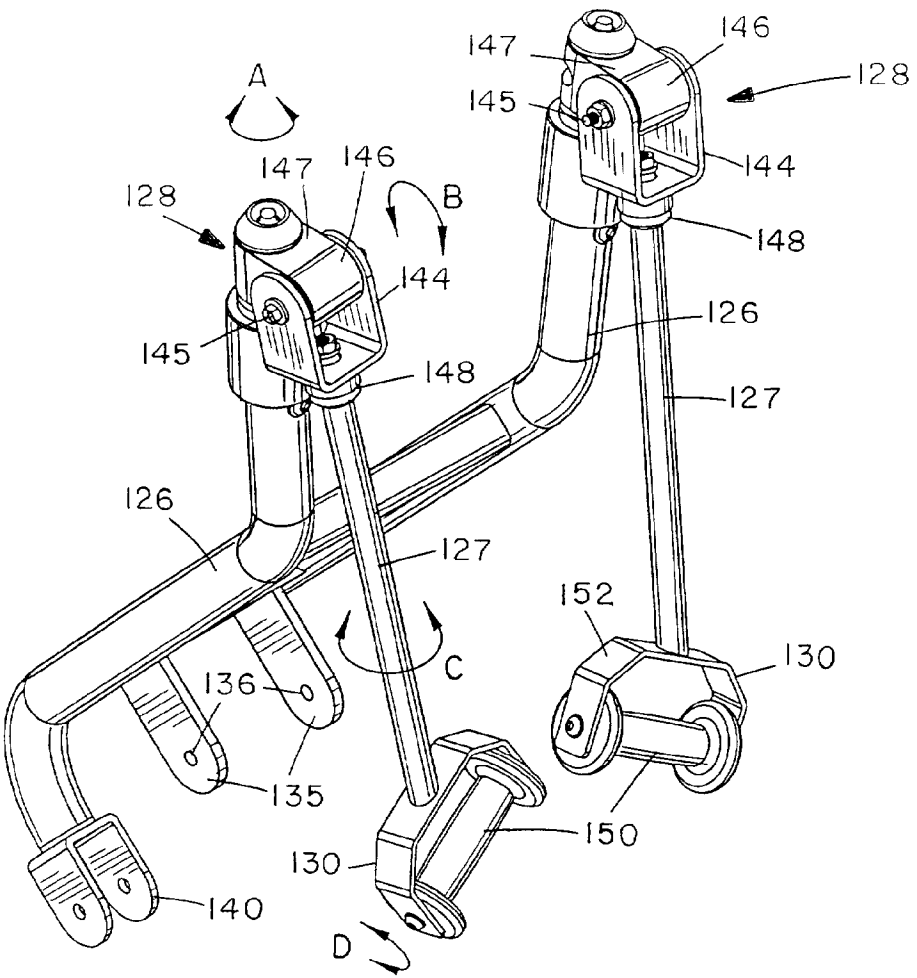
FIG. 16 is a perspective view of the first exercise arm and swing arms of FIGS. 13 to 15, illustrating the three axes of rotation of the swing arms relative to the exercise arm, and the fourth axis of rotation of the handle.

In addition to the three dimensional pivot joint, the handles 130 have hand grips 150 rotatably mounted between the ends of a C-shaped bracket 152 for rotation about their own axes, as indicated by the arrow D of FIG. 16. This provides a fourth pivot axis for allowing a user to adjust their hand and wrist orientation for comfort during the exercise movement. The four self-aligning pivots on each side of the exercise arm control side-to-side, front-to-back, and rotational movement of the swing arms, as well as rotation of the handgrips.

Figure 14:
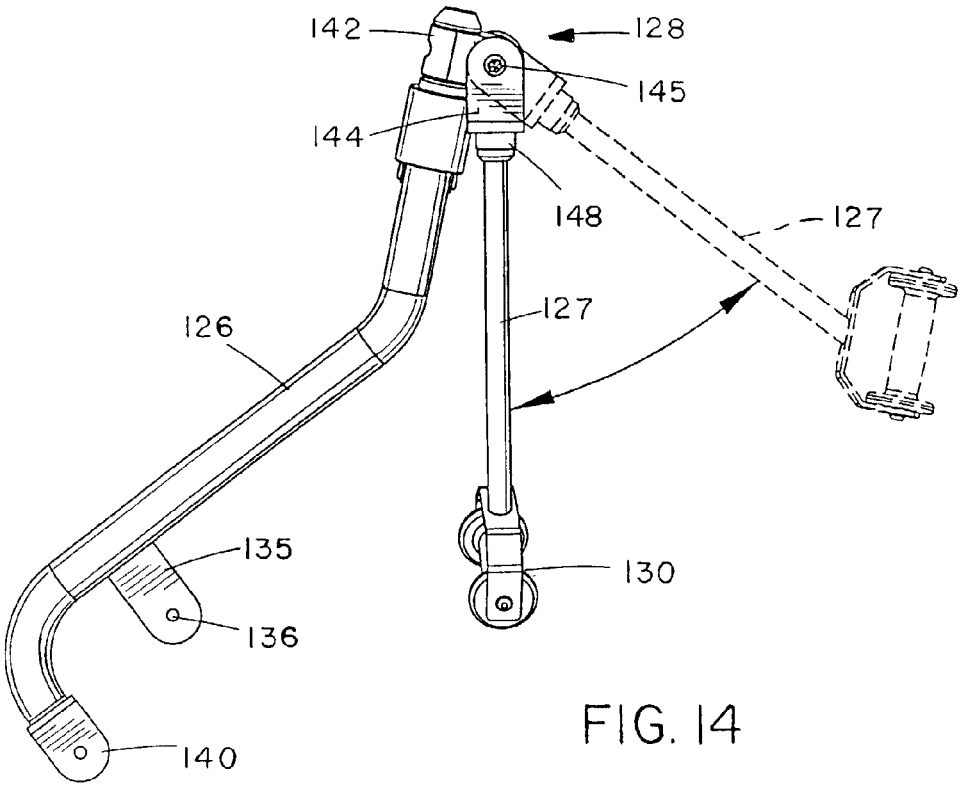
FIG. 14 is a side view of the components illustrated in FIG. 13, illustrating the swing arms extended forward and rotated to change the handle orientation.

FIG. 14 illustrates pivotal movement of the swing arms from a generally vertical, rest position as illustrated in solid outline, to a forwardly extended, rotated position of the swing arm, as indicated in dotted outline. Each swing arm 127 is rotated about the pivot axis defined by pivot pin 145 into a forwardly inclined position, and the arm 127 is also rotated about the pivot axis defined by sleeve 148 extending co-axially from the end of arm 127, such that the handle 130 is rotated through ninety degrees. The user may also rotate grip 150 if needed to adjust the hand/arm position for more comfort.

Figure 15:
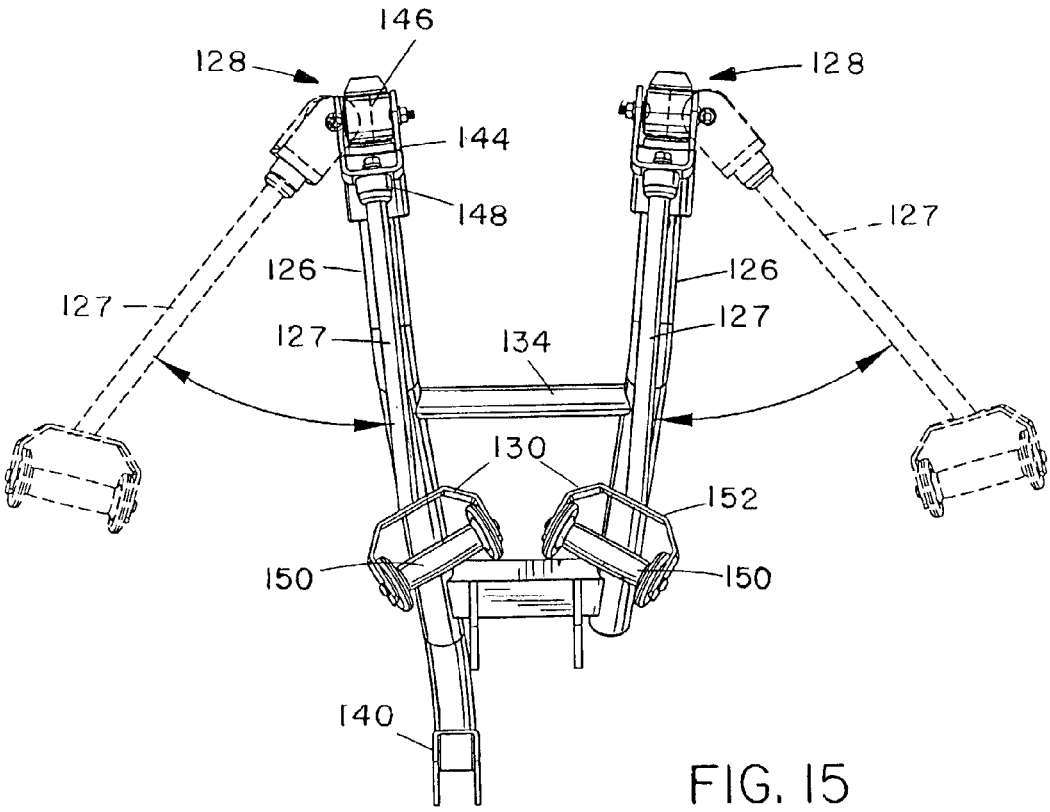
FIG. 15 is a front view similar to FIG. 13, illustrating the swing arms extended to the side.

FIG. 15 is a front view of the exercise arm and swing arm assembly, illustrating extension of each swing arm outwardly to the side. This involves rotation of each sleeve 142 about the axis of the exercise arm end portion, rotating the pivot bracket 144 through ninety degrees from the position illustrated in solid lines to the position illustrated in dotted outline. Clearly, arms 127 may also be rotated about their own axes in this position to change the handle orientation, and hand grips 150 may also be rotated.

Figure 17:
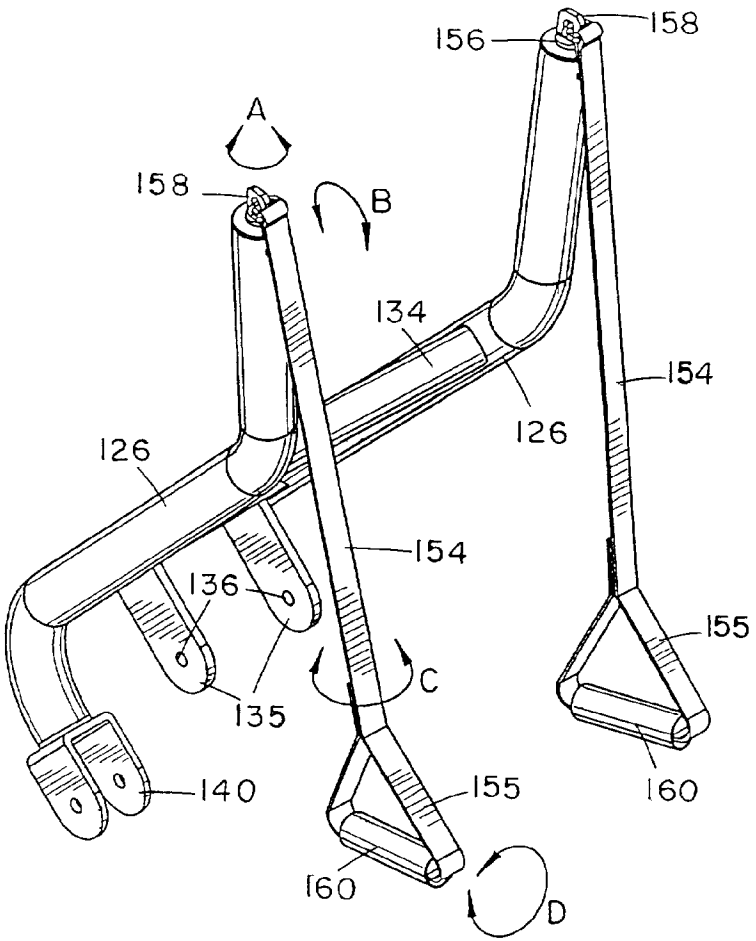
FIG. 17 is a perspective view similar to FIG. 16 illustrating an alternative embodiment in which the rigid swing arms are replaced by flexible straps.
Figure 18:
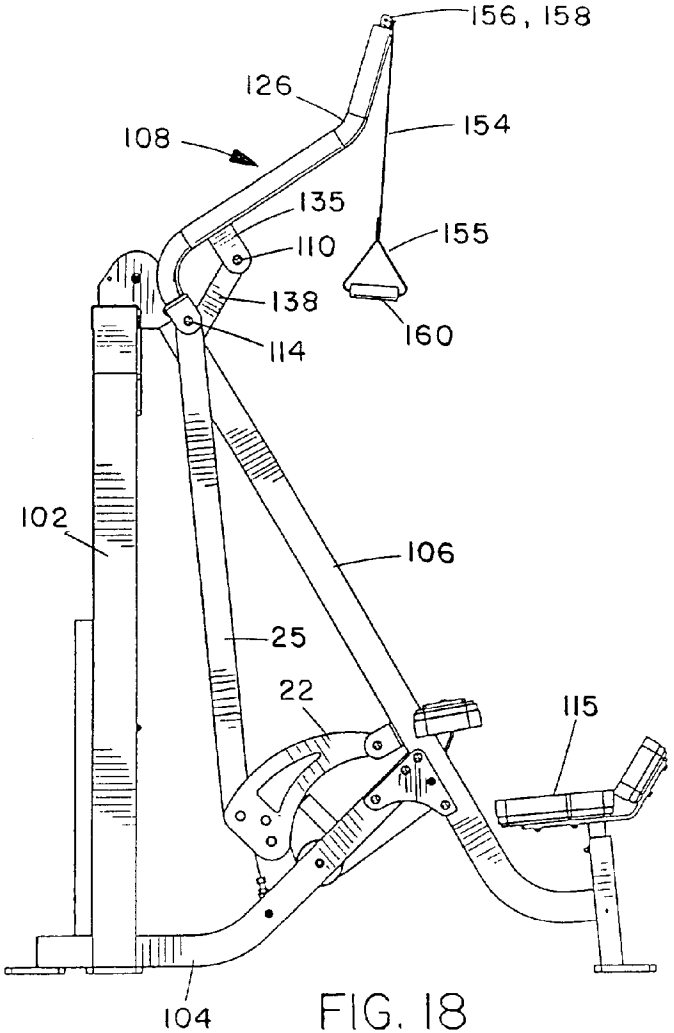
FIG. 18 is a side elevational view of the exercise apparatus incorporating the strap handles as illustrated in FIG. 17.

FIGS. 17 and 18 illustrate a modified first exercise arm and handle arrangement which still provides the three dimensional movement and handle rotation of the previous embodiment, but in which the rigid swing arms 127 and handle brackets 152 are replaced with flexible elongate straps 154 and strap handles 155. This embodiment is otherwise identical to the previous embodiment, and like reference numerals have been used for like parts as appropriate. The straps 154 may be provided in any desired length, and may be of adjustable length if desired. Each strap 154 has a ring or clip 156 at one end engaging through an eyelet 158 at the end of the respective side member 126, and is secured to a strap handle 155 of generally triangular shape at its opposite end. A tubular hand grip 160 is rotatably mounted on the base of triangular handle 155. As indicated in FIG. 17, this arrangement provides the same freedom of movement as the rigid swing arm arrangement of the previous embodiment, since the strap is free to rotate in the direction of arrows A, B and C due to the flexible material of the strap, and the rotating hand grip can be rotated about its own axis in the direction of arrow D. The flexible material of handle straps 154 allows them to move side-to-side, front-to-back and twist/rotate in the same fashion as the three dimensional swing arms 127 of the previous embodiment, as illustrated in FIG. 17. FIG. 18 illustrates the exercise arm with strap handles mounted on the exercise machine of FIGS. 10 to 12.

In each of the previous two embodiments, the exercise arm assembly is mounted on the frame by means of a four bar linkage system with a counterbalancing connecting link, as in the embodiments of FIGS. 1 to 9. However, unlike FIGS. 1 to 9, the first exercise arm of the four bar linkage in FIGS. 10 to 18 is linked to a swing arm assembly via a universal joint to provide a three dimensional exercise movement. The connecting link 25 in FIGS. 10 to 18, as in FIGS. 1 to 9, is formed as a counter-weight which acts to counter-balance the forwardly projecting portion of arm 108 forward of pivot 110, urging it into the rest position illustrated in FIGS. 10 and 18 when the handles are released. The construction of link 25 will be the same as in the previous embodiments, as described above in connection with FIGS. 1,2,4 and 5. Weight stack 40 in FIGS. 10 to 18 may also be replaced with weights mounted on the connecting link 25, as illustrated in FIGS. 6 and 7.

As in all of the previous embodiments, both pivoting members 108 and 22 travel in the same direction and pivot off the same frame member, with one pivoting member 108 acting as the exercise arm and the other pivoting member engaging the load. The handles are on the opposite side of the stationary frame member 106 from the connecting link, and therefore travel in the opposite direction from the connecting link. The counter balance or connecting link 25 also travels in a vertical direction and a substantially straight line.

Figure 19:
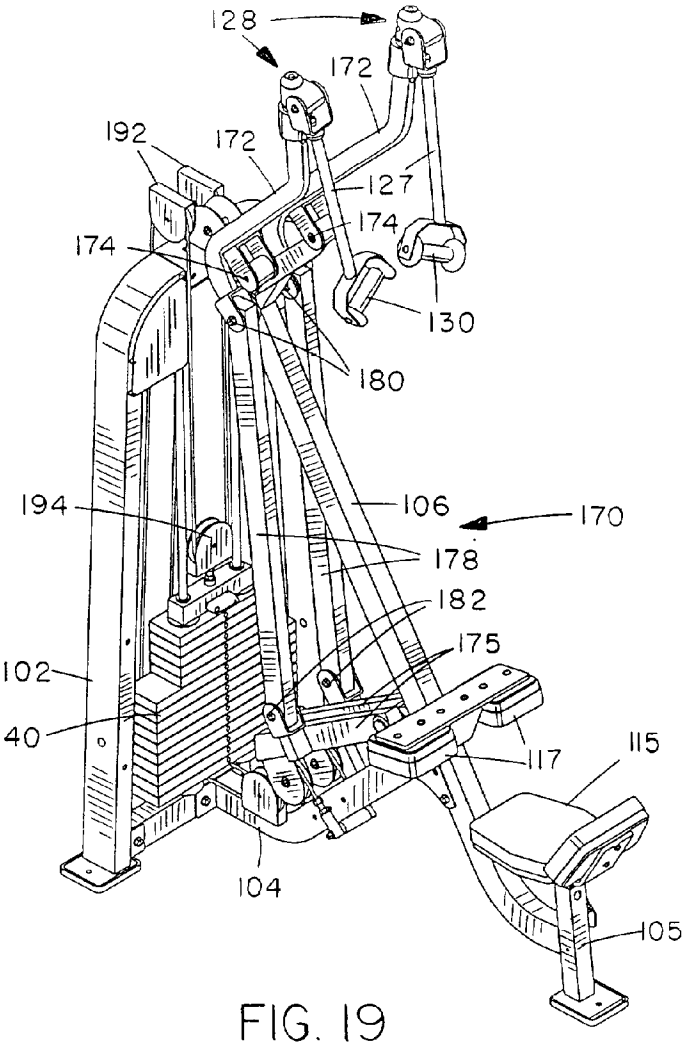
FIG. 19 is a front perspective view of an exercise apparatus according to another embodiment of the invention having two separate exercise arm assemblies to provide for independent arm movement.
Figure 21:
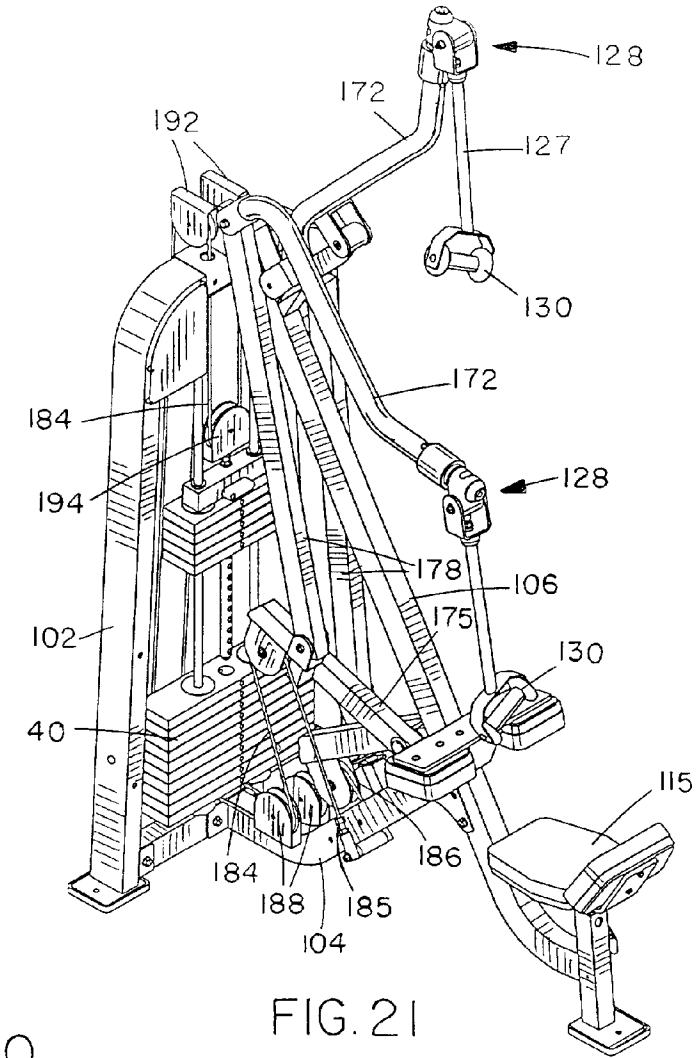
FIG. 21 is a front perspective view of the apparatus of FIG. 19 with the exercise arm assemblies in different positions.
Figure 20:
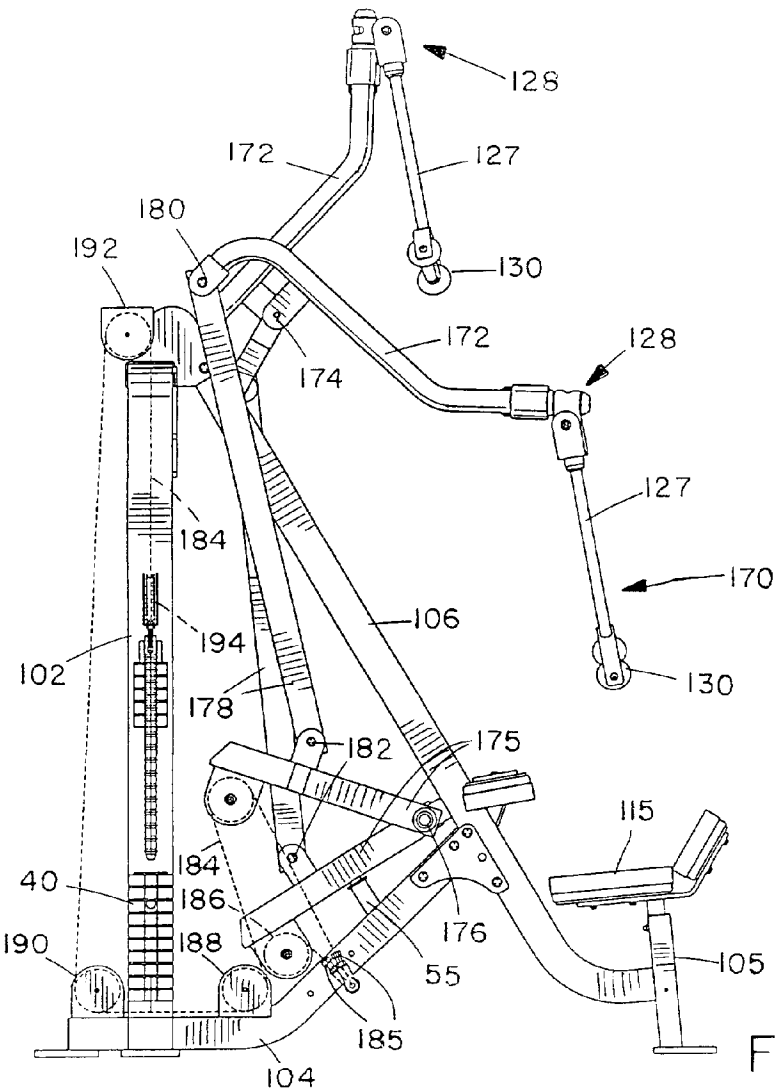
FIG. 20 is a side elevational view of the apparatus of FIG. 19 illustrating a possible exercise arm position in which one of the exercise arms is lower than the other, in order to illustrate the independent arm movement.

FIGS. 19 to 21 illustrate an exercise machine 170 according to another embodiment of the invention in which two separate exercise arm assemblies with separate four bar linkages are provided on each side of a frame member, so that the user can opt to actuate the two arm assemblies independently from each other. Each four bar linkage is similar to the single four bar linkage of FIGS. 10 to 16, and incorporates a three dimensional swing arm assembly. However, it will be understood that any of the previous embodiments may be modified in a similar manner to provide two independent four bar linkages for each handle or user engagement device, rather than a single four bar linkage connected to both handles or user engagement devices.

As in the previous embodiments, the machine of FIGS. 19 to 21 is designed for performing pulldown exercises, although it could alternatively be used for different types of pulling exercises. The machine frame and weight stack are equivalent to those of FIGS. 10 to 16, and like reference numerals have been used for like parts as appropriate. Two identical exercise arm assemblies are pivotally mounted on the frame on each side of the upwardly inclined strut 106. Each exercise arm assembly basically comprises a first exercise arm 172 pivoted to the frame member or strut 106 adjacent its upper end via pivot pin 174, a second pivoting arm 175 pivoted to the strut 106 at one end via pivot pin 176 at a location spaced below pivot pin 174, and a connecting link 178 having an upper end pivoted to the rear end of arm 172 via pivot pin 180, and a lower end pivoted to arm 175 at a location spaced from the rear end of the arm via pivot pin 182. This provides a four-bar linkage on each side of central strut 106.

A swing arm assembly identical to that of FIGS. 10 to 16 is secured at the forward end of each arm 172, and like reference numerals have been used for like parts as appropriate. It will be understood that a strap handle assembly as in FIGS. 17 and 18 may alternatively be secured at the free end of each arm 172, or handles may be directly secured to the ends of arms 172, as in FIGS. 1-9. Each connecting link 178 will be of similar construction to the connecting link 25 of the previous embodiments, so as to provide a counterweight to counter balance the weight of the forwardly projecting portion of the respective arm 172 and swing arm assembly.

Each arm 175 is separately linked to the weight stack 40 by a cable and pulley linkage, as indicated in the drawings. A cable 184 has opposite ends linked to anchors 185 on opposite sides of base strut 104, as illustrated in FIGS. 19 and 21, and extends from one anchor 185 around a pulley 186 at the end of the respective arm 175, a pulley 188 on the same side of strut 104, then under the weight stack and around a pulley 190 on the rear end of strut 104, then upwardly and around one of two pulleys 192 at the top of the strut 102. From this point the cable extends downwardly and around a pulley 194 at the top of the weight stack 40, then up around the other pulley 192, down around the second pulley 190, around the other pulley 188, and around the pulley 186 at the end of the other arm 175 before terminating at the second anchor 185. It will be understood that two separate cables may be used in place of the single cable 184, and that other linkage arrangements between the arms 175 and weight stack may alternatively be used. Also, other types of exercise resistance may be used for each exercise arm assembly, such as weight plates on the connecting link or counterweight 178 as in FIGS. 6 and 7, or other known types of exercise resistance commonly used in the exercise machine industry.

Thus, the independent exercise arm assemblies of FIGS. 19 to 21 can be actuated or pulled separately by a user, as indicated in FIGS. 20 and 21, or may be pulled together if desired. The load or resistance is distributed evenly to each arm, preventing the user's dominant arm from doing more of the work during an exercise movement. FIG. 19 illustrates the arm assemblies both in the up or starting position. A user seated on the seat 115 can grip the hand grips 150 of the handles 130, and can pull down on one or both handles against the selected resistance or load. Due to the three dimensional pivoting joint 128 between each swing arm 127 and the respective first arm 172, the user can also swing the arms outwardly and/or forwardly relative to the position illustrated in FIG. 19, in the manner indicated in FIGS. 13 to 16. In FIGS. 20 and 21, the right hand exercise arm 172 is in the up or starting position, while the left hand arm 172 has been pulled downwardly by the user. This pulls the respective connecting link 178 upwardly in a generally vertical or slightly offset from vertical direction. In turn, this motion pulls second arm 175 upwardly, such that it rotates about pivot 176 at its forward end into the upwardly inclined position illustrated in FIG. 20, lifting the selected stack of weights into the raised position illustrated in FIGS. 20 and 21.

The exercise machines of FIGS. 10 to 21 all provide a three-dimensional, user defined movement of the handgrips, allowing the user to let their hands follow a more natural and comfortable exercise path during pulldown or other types of exercises. At the same time, the independent exercise arm assemblies in the alternative of FIGS. 19 to 21 permits the user to use the exercise arms separately in an alternating arm movement, or to pull the arms together with both arms of the user moving simultaneously in the same direction. As noted above, this will help to prevent a user's dominant arm from doing more of the work in an exercise movement, and a similar arrangement may also be used in any of the embodiments of FIGS. 1 to 9.

In each of the above embodiments, an exercise arm apparatus has a four-bar linkage system using a counterweight which comprises the connecting link of the four-bar linkage. The connecting link is a solid steel or other metal bar which has a weight per linear foot of over four times that of conventional, hollow metal tubing normally used for such connecting links. Thus, the necessary weight to offset the exercise arm is provided without needing to add any extra components such as additional weights to the four-bar linkage, reducing expense and making the apparatus safer and more compact. The size of the counter-balancing connecting link can be varied based on the weight needed to offset the weight of the forward portion of the exercise arm assembly.

The rear portion of the first exercise arm travels in the same direction as the second pivoting arm in all of the embodiments, both arms pivot off the same frame member, and the handles travel in the opposite direction to the connecting link. The arrangement of the pivotal linkage is such that the connecting link will travel in a substantially vertical path throughout the exercise motion, reducing the machine space needed to accommodate the linkage and also avoiding a resistance change which may otherwise be felt by the exerciser as a result of any counterweight following an arcuate path. The exercise resistance, which may be a load-bearing cable attached to the second arm or to the connecting link, or weight plates removably mounted on the connecting link, will also travel in a substantially straight line, vertical direction, also avoiding any drop off or decrease in resistance felt by the exerciser. Due to the compact design, the four-bar linkage system will take up less space on the machine, providing a more compact machine which takes up less floor space. Since the second pivoting arm is shorter than the first arm, the distance that the four-bar linkage projects rearwardly from the frame member is reduced, and the rear profile is more compact, requiring less machine space. By making the connecting link as a dual purpose part, performing the function of pivotally linking the two arms of the linkage as well as providing the necessary counterweight to counterbalance the exercise arm, the need for an additional part to provide a counterbalance is eliminated, considerably reducing material and assembly expense and complexity.

The exercise arm assembly in the above embodiments is arranged for performing pulldown exercises. However, it could alternatively be used for a different type of pulling exercise such as a triceps dip, or a pushing exercise such as a shoulder press. In the latter case, the exercise arm and handles would rest in the down position. The counter-balancing connecting link would then travel in a downward path during the exercise movement, and be used to offset the starting weight of the exercise arm, but not enough to restrict it from returning to the start position. The four bar linkage system with integral counter-weight of this invention could be mounted at a different location on the frame relative to the user position, provided that there is enough of an angle for the counter-balancing effect to take place. For example, it could alternatively be mounted above the user position at an angle to perform an incline press exercise, or below the user position to perform a mid-row exercise.

The connecting link may be adjustable in length to change the elevation of the exercise arm handles, for example by making it in two telescopically engaging parts, while still providing the counter-balancing effect, by making the inner telescoping part of solid metal bar. In another alternative, the single solid bar connecting link may be replaced by two parallel, solid bar connecting links secured to opposite sides of the second pivoting arm. Additionally, the four-bar linkage system could be mounted at a different location relative to the user position or seat in order to perform different exercises, providing that there is enough of an angle for the counter-balancing effect to take place. For example, the assembly could be pivoted to the frame at a location above the user position to perform an incline press exercise, or below the user position to perform a mid-row exercise.

Instead of a U-shaped exercise arm or yoke as in the embodiments of FIGS. 1 to 18, the entire exercise arm 18 could be a single member, with one or more handles attached at its forward end. Additionally, two completely independent exercise arms may be used, as in FIGS. 19 to 21, with each arm forming part of a separate four-bar linkage having a counter-balancing connecting link. The attachment point for the load-bearing cable may also be changed from the position illustrated, provided it is still pulled in a substantially straight line. For example, the cable may be attached directly to the lower end of the counter-balancing connecting link, rather than to the second arm of the four-bar linkage. Additionally, the cable may be a belt, rope, chain, or other type of load bearing line.

The cross-sectional shape, dimensions and material of the counterbalancing connecting link may also be changed, as long as it provides sufficient weight for the desired counter-balancing effect. In the illustrated embodiment, it is of 2" by 2" square, solid steel bar. However, it may alternatively be of cylindrical or rectangular shape. The material may be cast iron, cement, or some other form of heavy material.

Another benefit of this invention is safety. The design of the counterbalancing connecting link avoids the need for having a weight added to the end of a pivoting member or exercise arm, which could potentially strike or injure someone when it swings upward and outward in an arcing motion. In this invention, the counter-balancing connecting link is attached at or close to the end of an exercise arm, avoiding having a projecting end portion swinging up and down at the rear of a machine, which is dangerous. The vertical or close to vertical direction of movement of the connecting link is also safer than an arrangement which has pivoting members which arc upwardly and outwardly.

The exercise apparatus of this invention is also less expensive to manufacture than previous arrangements which required a large block of steel placed at the end of a pivot member or exercise arm. In this invention, part of the four bar linkage itself is employed as the counter-weight, avoiding the need for an additional block of metal which has no other purpose than providing the counter-weight. This means that less material is required, and the construction is also simpler, further reducing costs.

Although some exemplary embodiments of the invention have been described above by way of example only, it will be understood by those skilled in the field that modifications may be made to the disclosed embodiments without departing from the scope of the invention, which is defined by the appended claims.

I claim:

1. An exercise apparatus, comprising:

a stationary frame having a forward end and a rear end;

an exercise arm assembly pivotally mounted on the frame;

an exercise resistance linked to the exercise arm assembly;

the exercise arm assembly comprising a first, exercise arm pivotally connected to the frame for rotation about a first pivot axis, the first exercise arm having a forward portion projecting forwardly from the first pivot axis and a rear portion projecting rearwardly from the first pivot axis, a second arm pivotally connected to the frame for rotation about a second pivot axis spaced from the first pivot axis, and a connecting link pivotally connected to the rear portion of the first arm and to the second arm;

the connecting link comprising a counter-weight of predetermined weight to counter-balance the forward portion of the first exercise arm into a rest position; and at least one elongate swing arm having opposite first and second ends, the first end of the swing arm linked to the forward portion of the first exercise arm, a handle linked to the second end of the swing arm for gripping by a user to perform selected exercises, and a universal joint linking the first end of the swing arm to the forward portion of the first exercise arm for allowing movement of the swing arm about three perpendicular axes.

2. The apparatus as claimed in claim 1, wherein the swing arm is a rigid arm and the universal joint comprises a three dimensional pivot assembly.

3. An exercise apparatus, comprising:

a stationary frame having a forward end and a rear end;

an exercise arm assembly pivotally mounted on the frame;

an exercise resistance linked to the exercise arm assembly;

the exercise arm assembly comprising a first, exercise arm pivotally connected to the frame for rotation about a first pivot axis, the first exercise arm having a forward portion projecting forwardly from the first pivot axis and a rear portion projecting rearwardly from the first pivot axis, a second arm pivotally connected to the frame for rotation about a second pivot axis spaced from the first pivot axis, and a connecting link pivotally connected to the rear portion of the first arm and to the second arm;

the connecting link comprising a counter-weight of predetermined weight to counter-balance the forward portion of the first exercise arm into a rest position; and an elongate flexible strap having a first end linked to the forward portion of the first exercise arm and a handle at the second end of the strap.

4. An exercise apparatus, comprising:

a stationary frame having a forward end and a rear end;

an exercise arm assembly pivotally mounted on the frame;

an exercise resistance linked to the exercise arm assembly;

the exercise arm assembly comprising a first, exercise arm pivotally connected to the frame for rotation about a first pivot axis, the first exercise arm having a forward portion projecting forwardly from the first pivot axis and a rear portion projecting rearwardly from the first pivot axis, a second arm pivotally connected to the frame for rotation about a second pivot axis spaced from the first pivot axis, and a connecting link pivotally connected to the rear portion of the first arm and to the second arm;

the connecting link comprising a counter-weight of predetermined weight to counter-balance the forward portion of the first exercise arm into a rest position;

at least one elongate swing arm having opposite first and second ends, the first end of the swing arm linked to the forward portion of the first exercise arm, a handle linked to the second end of the swing arm for gripping by a user to perform selected exercises, and a universal joint linking the first end of the swing arm to the forward portion of the first exercise arm for allowing movement of the swing arm about three perpendicular axes; and the forward portion of the first exercise arm being generally U-shaped with a central portion and two side portions, the central portion being connected to the rear portion, and further comprising two elongate swing arms each having a first end pivotally connected to the respective forward ends of the side portions via a respective universal joint.

5. An exercise apparatus, comprising:

a frame having a forward end and a rear end;

the frame having a user supporting portion;

a user support seat mounted on the user supporting portion of the frame;

a first exercise arm assembly pivotally mounted on the frame;

a second, separate exercise arm assembly pivotally mounted on the frame side-by-side with the first exercise arm assembly, the second exercise arm assembly being identical to the first exercise arm assembly;

an exercise resistance linked to each exercise arm assembly;

each exercise arm assembly comprising a first, exercise arm pivotally connected to the frame for rotation about a first pivot axis, the first exercise arm having a forward portion projecting forwardly from the first pivot axis and a rear portion projecting rearwardly from the first pivot axis, a second arm pivotally connected to the frame for rotation about a second pivot axis spaced from the first pivot axis, and a connecting link pivotally connected to the rear portion of the first arm and to the second arm, the connecting link comprising a counter-weight of predetermined weight to counter-balance the forward portion of the first exercise arm into a rest position;

the connecting link comprising a counter-weight of predetermined weight to counter-balance the forward portion of the first exercise arm into a rest position, the counter-weight being separate and spaced from the user supporting portion of the frame; and the apparatus further comprising first and second user engagement devices connected to the forward portions of the first exercise arms of the respective exercise arm assemblies for direct engagement by a user in performing exercises, the exercise resistance being separately linked to the first and second exercise arm assemblies, whereby the two exercise arm assemblies can be operated independently or simultaneously by a user.

6. The apparatus as claimed in claim 5, wherein the user engagement devices each comprise a handle pivotally connected to the forward portion of the respective first exercise arm.

7. The apparatus as claimed in claim 5, wherein each user engagement device comprises an elongate swing arm having a first end pivotally connected to the forward portion of the respective first exercise arm and a second end, and a handle connected to the second end of the swing arm.

8. The apparatus as claimed in claim 7, including a three dimensional pivot joint connecting the first end of each swing arm to the forward portion of the respective first exercise arm.

9. The apparatus as claimed in claim 1, wherein the connecting link is a solid steel bar.

10. The apparatus as claimed in claim 9, wherein the solid steel bar is a 2 inch by 2 inch solid steel bar.

11. The apparatus as claimed in claim 1, wherein the connecting link has a weight of at least 10 lbs. per linear foot.

12. The apparatus as claimed in claim 1, wherein the stationary frame includes a generally upwardly directed strut, the first exercise arm being pivoted to the strut at a first position for rotation about said first pivot axis, and the second arm being pivoted to the strut at a second position spaced from the first position for rotation about said second pivot axis.

13. The apparatus as claimed in claim 1, wherein the second arm and rear portion of the first ann pivot in the same direction.

14. The apparatus as claimed in claim 1, wherein the exercise resistance comprises a plurality of weight plates removably mounted on the connecting link.

15. The apparatus as claimed in claim 1, wherein the stationary frame includes a stop member for engaging the second arm in the rest position.

16. An exercise arm apparatus, comprising:

a stationary frame member;

an exercise resistance mounted on the frame member;

a first pivoting arm having opposite first and second ends, the first arm being pivotally connected to the frame at an intermediate location between its ends for rotation about a first pivot axis, the first exercise arm having a first end portion projecting in a first direction from the frame member and a second portion projecting in an opposite, second direction from the frame member, the first pivoting arm comprising an exercise arm for engagement by a user;

a second pivoting arm pivotally connected to the frame member for rotation about a second pivot axis spaced from the first pivot axis;

a connecting link pivotally connected to the second portion of the first arm and to the second arm;

whereby the frame member, first and second arms, and connecting link together form a first four-bar linkage;

the connecting link comprising a counter-weight of predetermined weight to counter-balance the first portion of the first exercise arm into a rest position corresponding to a start position for an exercise movement;

the exercise resistance being linked to the first four-bar linkage; and at least one elongate swing arm having opposite first and second ends, the first end being linked to the first end portion of the first arm, a handle linked to the second end of the swing arm for gripping by a user to perform selected exercises, and a universal joint linking the first end of the swing arm to the forward portion of the first arm.

17. The apparatus as claimed in claim 16, wherein the swing arm is a rigid arm and the universal joint comprises a three dimensional pivot assembly.

18. The apparatus as claimed in claim 16, wherein the swing arm is a flexible strap and the universal joint comprises a ring at the first end of the strap and an eyelet on the forward portion of the swing arm, the ring extending through the eyelet.

19. The apparatus as claimed in claim 16, wherein the first end portion of the first exercise arm is generally U-shaped with a central portion and two side portions, the central portion being connected to the second end portion, and further comprising two elongate swing arms each having a first end pivotally connected to the forward end of the respective side portion via a respective universal joint.

20. An exercise arm apparatus, comprising:

a stationary frame member;

an exercise resistance mounted on the frame member;

a first pivoting arm having opposite first and second ends, the first arm being pivotally connected to the frame at an intermediate location between its ends for rotation about a first pivot axis, the first exercise arm having a first end portion projecting in a first direction from the frame member and a second portion projecting in an opposite, second direction from the frame member, the first pivoting arm comprising an exercise arm for engagement by a user;

a second pivoting arm pivotally connected to the frame member for rotation about a second pivot axis spaced from the first pivot axis; and a connecting link pivotally connected to the second portion of the first arm and to the second arm;

whereby the frame member, first and second arms, and connecting link together form a first four-bar linkage;

the connecting link comprising a counter-weight of predetermined weight to counter-balance the first portion of the first exercise arm into a rest position corresponding to a start position for an exercise movement;

the exercise resistance being linked to the first four-bar linkage;

the stationary frame having a central portion, the first four bar linkage being pivotally mounted on the frame on a first side of the central portion, and a second four bar linkage identical to the first four bar linkage being pivotally mounted alongside the first four bar linkage on the opposite side of the central portion of the frame, and first and second user engagement devices are connected to the first end portions of the first arms of the respective first and second four bar linkages, the exercise resistance being separately linked to said first and second four bar linkages for movement of each four bar linkage independent from movement of the other four bar linkage.

21. The apparatus as claimed in claim 20, wherein the user engagement devices each comprise a handle pivotally connected to the forward portion of the respective first arm.

22. The apparatus as claimed in claim 20, wherein each user engagement device comprises an elongate swing arm having a first end pivotally connected to the forward portion of the respective first arm and a second end, and a handle connected to the second end of the swing arm.

23. The apparatus as claimed in claim 22, including a three dimensional pivot joint connecting the first end of each swing arm to the forward portion of the respective first exercise arm.

24. The apparatus as claimed in claim 20, wherein the connecting link comprises at least one elongate, solid bar.

25. The apparatus as claimed in claim 24, wherein the bar is of a material selected from the group consisting of steel, cast iron, and concrete.

26. The apparatus as claimed in claim 24, wherein the bar has a weight per unit length at least twice the weight of hollow tubing of the same material and dimensions.

27. The apparatus as claimed in claim 20, wherein the connecting link travels in a substantially straight line path from the rest position to an end position of an exercise movement.

* * * * *